US007261399B2

(12) United States Patent
Miki

(10) Patent No.: US 7,261,399 B2
(45) Date of Patent: Aug. 28, 2007

(54) METHOD OF MAINTENANCE FOR INK JET HEAD AND IMAGE FORMING APPARATUS

(75) Inventor: Motoharu Miki, Hachioji (JP)

(73) Assignee: Olympus Corporation, Tokyo (JP)

( * ) Notice: Subject to any disclaimer, the term of this patent is extended or adjusted under 35 U.S.C. 154(b) by 344 days.

(21) Appl. No.: 11/038,670

(22) Filed: Jan. 19, 2005

(65) Prior Publication Data

US 2005/0185033 A1 Aug. 25, 2005

(30) Foreign Application Priority Data

Jan. 21, 2004 (JP) ..... 2004-013283

(51) Int. Cl.
*B41J 2/175* (2006.01)
*B41J 2/165* (2006.01)

(52) U.S. Cl. ..... 347/85; 347/23

(58) Field of Classification Search ..... 347/7, 347/14, 19, 23, 29, 30, 85, 92
See application file for complete search history.

(56) References Cited

U.S. PATENT DOCUMENTS 5,485,187 A * 1/1996 Okamura et al. ..... 347/85
6,168,268 B1 * 1/2001 Sugiyama ..... 347/89
6,196,668 B1 * 3/2001 Bode ..... 347/85
6,199,976 B1 * 3/2001 Sasada ..... 347/85
6,234,615 B1 * 5/2001 Tsukuda ..... 347/85
6,281,916 B1 * 8/2001 VanSteenkiste ..... 347/85
6,513,902 B1 * 2/2003 Amano et al. ..... 347/23
6,840,604 B2 * 1/2005 Kimura et al. ..... 347/85

FOREIGN PATENT DOCUMENTS

JP 2002-347260 A 12/2002

* cited by examiner

*Primary Examiner*—Anh T. N. Vo
(74) *Attorney, Agent, or Firm*—Frishauf, Holtz, Goodman & Chick, P.C.

(57) ABSTRACT

Air from a pressurizing pump is supplied to a plurality of ink jet heads through an air tank and a plurality of ink tanks, and head inner pressures of the respective ink jet heads are raised. Accordingly, ink liquids are discharged from the respective ink jet heads. Thereafter, the desired ink tank among the respective ink tanks is allowed to communicate with the air tank. Moreover, the desired ink tank and at least one or more air tanks are opened to the atmosphere. In consequence, pressure in the desired ink tank is averaged.

21 Claims, 15 Drawing Sheets

METHOD OF MAINTENANCE FOR INK JET HEAD AND IMAGE FORMING APPARATUS

CROSS-REFERENCE TO RELATED APPLICATIONS

This application is based upon and claims the benefit of priority from prior Japanese Patent Application No. 2004-013283, filed Jan. 21, 2004, the entire contents of which are incorporated herein by reference.

BACKGROUND OF THE INVENTION

1. Field of the Invention

The present invention relates to a method of maintenance for an ink jet head in a case where ink of each color is spouted from a plurality of ink jet heads to thereby form an image on an image forming medium, and an image forming apparatus using this method.

2. Description of the Related Art

As shown in FIG. 16, a plurality of ink jet heads 1 are used in an ink jet system image forming apparatus. Each ink jet head 1 has a nozzle plate 3 and piezoelectric elements (PZT) 4. A plurality of nozzles 2 are formed in the nozzle plate 3. A piezoelectric element 4 is disposed for each of the nozzles 2. Each ink jet head 1 has an ink chamber 5 formed by the piezoelectric element 4 for each nozzle 2.

Respective ink jet heads 1 are disposed for the colors of black (K), cyan (C), magenta (M), and yellow (Y). Each ink chamber 5 of the ink jet head 1 is charged with each color of ink 6. When each piezoelectric element 4 is displaced/operated at an image forming time, the pressure in each ink chamber 5 rises. The ink 6 is spouted from each nozzle 2.

When a back pressure is applied to each ink chamber 5 in the ink jet head 1, a meniscus 7 is formed in each nozzle 2.

Additionally, when dust, dirt, air, degraded ink liquid and the like are mixed in the ink chamber 5, and deposits such as dust and dirt adhere to the nozzle 2 or the vicinity of the nozzle 2, the meniscus 7 collapses. Therefore, the amount of each ink 6 spouted from the nozzle 2 is not appropriate. A jet direction of the ink 6 changes. As a result, a high-quality image cannot be formed.

Therefore, maintenance for the ink jet head 1 is performed. For example, the following technique is described in Jpn. Pat. Appln. KOKAI Publication No. 2002-347260.

A predetermined nozzle in the ink jet head is sealed by sealing means such as a suction cap. The inside of the sealing means is sealed, and brought into a negative pressure state. In this state, the sealing means including the suction cap or the like is swept/moved with respect to the ink jet head. The sealing means including the suction cap sucks remaining ink in the nozzle. Accordingly, bubbles or foreign matter in the nozzles is discharged.

In the maintenance for the ink jet heads 1, the bubbles, foreign matter and the like in the nozzles 2 and the ink chambers 5 are discharged, collapsed meniscuses 7 are recovered, and generation of newly collapsed meniscuses 7 is prevented. When the sealing means brought into the negative pressure state is simply swept and moved as in the Jpn. Pat. Appln. KOKAI Publication No. 2002-347260, it is difficult to securely recover the meniscuses 7 in the nozzles 2 of the ink jet heads 1.

To solve the problem, in a constitution shown in FIG. 17, maintenance for ink jet heads **1*k*-1 to 1*y*-6** is performed for each color (K, C, M, Y).

The plurality of ink jet heads **1*k*-1 to 1*y*-6 are connected to distributors 10-1 to 10-4 for each color (K, C, M, Y). The respective distributors 10-1 to 10-4 are connected to ink tanks (sub-tanks) 12-1 to 12-4 via tubes 11-1 to 11-4**.

The respective ink tanks 12-1 to 12-4 are charged with inks **6*k*, 6*c*, 6*m*, 6*y* of the respective colors. The respective ink tanks 12-1 to 12-4 are connected to atmosphere open tubes 13-1 to 13-4. The respective atmosphere open tubes 13-1 to 13-4 are provided with atmosphere open valves 14-1 to 14-4. It is to be noted that liquid level height positions of the respective inks 6*k*, 6*c*, 6*m*, 6*y* in the ink tanks 12-1 to 12-4, and height positions of the respective nozzles 2 of the ink jet heads 1*k*-1 to 1*y*-6 are set to a difference of elevation optimum for applying a back pressure to the respective ink chambers 5 of the ink jet heads 1*k*-1 to 1*y*-6 to thereby form the meniscuses 7 in the nozzles 2**.

The ink tanks 12-1 to 12-4 are connected to air tanks 16-1 to 16-4 via communication tubes 15-1 to 15-4. The respective communication tubes 15-1 to 15-4 are provided with pressurizing valves 17-1 to 17-4. The ink tanks 12-1 to 12-4 are connected to ink bottles (not shown) of the respective colors. The inks **6*k*, 6*c*, 6*m*, 6*y* of the respective colors are supplied to the ink tanks 12-1 to 12-4** from the respective ink bottles.

The respective air tanks 16-1 to 16-4 are connected to pressurizing pumps 19-1 to 19-4 via pressurizing tubes 18-1 to 18-4.

Cleaning members **20*k*-1, 20*k*-2, 20*k*-6 are disposed for the ink jet heads 1*k*-1 to 1*y*-6. In FIG. 17, the only cleaning members 20*k*-1 to 20*k*-6** for the color K are shown in order to avoid laborious drawing.

The respective cleaning members **20*k*-1 to 20*k*-6 are connected to a suction pump 22 via a suction tube 21. The respective cleaning members (suction heads) 20*k*-1 to 20*k*-6 and suction nozzles for the other colors slide with respect to the ink jet heads 1*k*-1 to 1*y*-6**.

Next, a maintenance operation will be described.

First, the respective atmosphere open valves 14-1 to 14-4 close. Moreover, the pressurizing valves 17-1 to 17-4 close.

Next, the respective pressurizing pumps 19-1 to 19-4 are driven. Air from the pressurizing pumps 19-1 to 19-4 is supplied to the air tanks 16-1 to 16-4 through the pressurizing tubes 18-1 to 18-4. At this time, since the pressurizing valves 17-1 to 17-4 are closed, pressures in the air tanks 16-1 to 16-4 rise.

When the pressures in the air tanks 16-1 to 16-4 reach predetermined pressures (pressures required for purging), the pressurizing valves 17-1 to 17-4 are opened. Accordingly, the purge pressures in the air tanks 16-1 to 16-4 are applied to the ink tanks 12-1 to 12-4 through the pressurizing valves 17-1 to 17-4. The pressures in the ink tanks 12-1 to 12-4 rise.

By the rising of the pressures, the respective inks **6*k*, 6*c*, 6*m*, 6*y* of the colors stored in the ink tanks 12-1 to 12-4 are supplied to the distributors 10-1 to 10-4 via the tubes 11-1 to 11-4. Furthermore, the inks 6*k*, 6*c*, 6*m*, 6*y* are supplied to the ink jet heads 1*k*-1 to 1*y*-6**.

Accordingly, the respective inks **6*k*, 6*c*, 6*m*, 6*y* are discharged from the nozzles 2 of the ink jet heads 1*k*-1 to 1*y*-6. When the inks 6*k*, 6*c*, 6*m*, 6*y* are discharged, bubbles, foreign matter and the like in the nozzles 2 and the ink chambers 5 are discharged. The discharging of the bubbles, foreign matters and the like in the nozzles 2 and ink chambers 5 by the discharging of the inks 6*k*, 6*c*, 6*m*, 6*y*** is referred to as purging.

Next, the respective atmosphere open valves 14-1 to 14-4 are opened. Accordingly, the pressures in the ink tanks 12-1 to 12-4 are reduced. At this time, when open/close timings of the atmosphere open valves 14-1 to 14-4 are controlled, pressure reduction in the ink tanks 12-1 to 12-4 is controlled. By this control, the pressures in the ink chambers 5 of the ink jet heads 1*k*-1 to 1*y*-6 are set to predetermined micro-positive pressures.

By the setting of the micro-positive pressures, the inks 6*k*, 6*c*, 6*m*, 6*y* are gradually discharged from the nozzles 2 of the ink jet heads 1*k*-1 to 1*y*-6. It is to be noted that even when the respective inks 6*k*, 6*c*, 6*m*, 6*y* are gradually discharged from the nozzles 2, the ink remains to such an extent that the ink does not drop onto the nozzle plate. This state is maintained before/after a sucking operation described later.

In this state, the respective cleaning members 20*k*-1 to 20*k*-6 are brought into contact with the nozzle plates 3 of the ink jet heads 1*k*-1 to 1*y*-6, and slid. Accordingly, the cleaning members 20*k*-1 to 20*k*-6 scrape and suck the inks 6*k*, 6*c*, 6*m*, 6*y* discharged to the nozzle plates 3 of the ink jet heads 1*k*-1 to 1*y*-6. Accordingly, the cleaning members 20*k*-1 to 20*k*-6 remove deposits adhering to the nozzle plates 3. To move the cleaning members 20*k*-1 to 20*k*-6 while removing the deposits from the nozzle plates 3 will be referred to as sucking.

Next, the atmosphere open valves 14-1 to 14-4 are opened. When the atmosphere open valves 14-1 to 14-4 are left in the open state, back pressures are applied in the ink chambers 5 of the ink jet heads 1*k*-1 to 1*y*-6. The meniscuses 7 are formed in the nozzles 2 of the ink jet heads 1*k*-1 to 1*y*-6.

BRIEF SUMMARY OF THE INVENTION

According to a main aspect of the present invention, there is provided a method of maintenance for an ink jet head, comprising: distributing air into a plurality of ink tanks from a pressurizing pump through an air tank, raising head inner pressures of the plurality of ink jet heads through the respective ink tanks, and discharging ink liquids from the respective ink jet heads; and thereafter allowing a desired ink tank among the ink tanks to communicate with the air tank, and opening to the atmosphere the desired ink tank and at least one or more air tanks among the air tanks to average the pressure in the desired ink tank.

According to a main aspect of the present invention, there is provided an image forming apparatus comprising: a plurality of ink tanks which store ink; a plurality of ink jet heads which jet the ink supplied from the respective ink tanks to thereby form an image on an image forming medium; a pressurizing pump which supplies air; an air tank which communicates with the pressurizing pump; a plurality of pressurizing valves which connect the air tank to the respective ink tanks, respectively; atmosphere open valves which are disposed in the respective ink tanks and at least one of the air tanks in such a manner that the inside of the air tank is openable to the atmosphere; an ink discharge control unit which opens the respective pressurizing valves and which drives the pressurizing pump and which supplies air to the respective ink jet heads from the air tank through the respective ink tanks to raise head inner pressures of the respective ink jet heads and which discharges the ink from the respective ink jet heads; and a pressure averaging control mechanism which discharges the ink from the respective ink jet heads and which thereafter opens the respective pressurizing valves and which opens the atmosphere open valve to thereby average the pressures in the respective ink tanks.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 16:
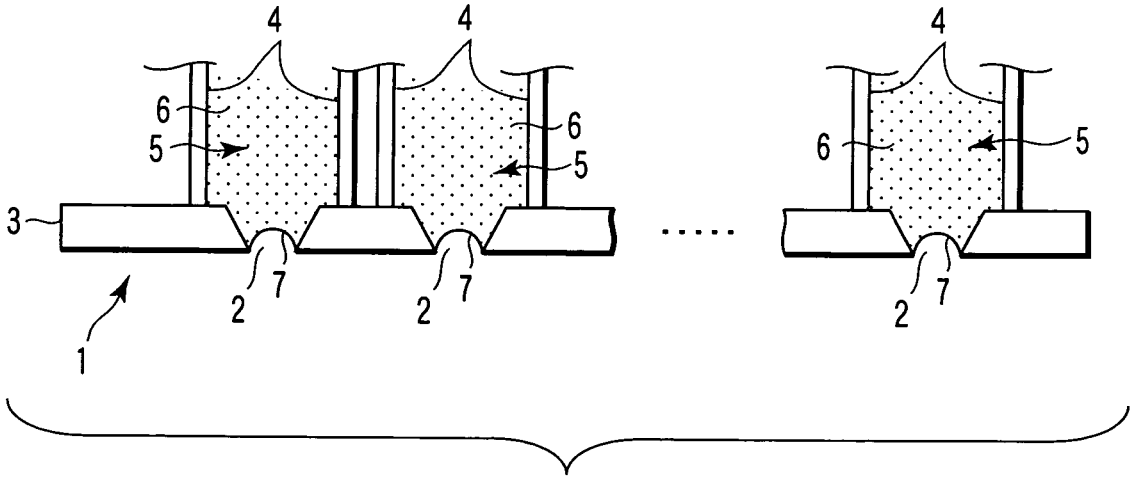
FIG. 16 is a schematic constitution diagram of an ink jet head.
Figure 17:
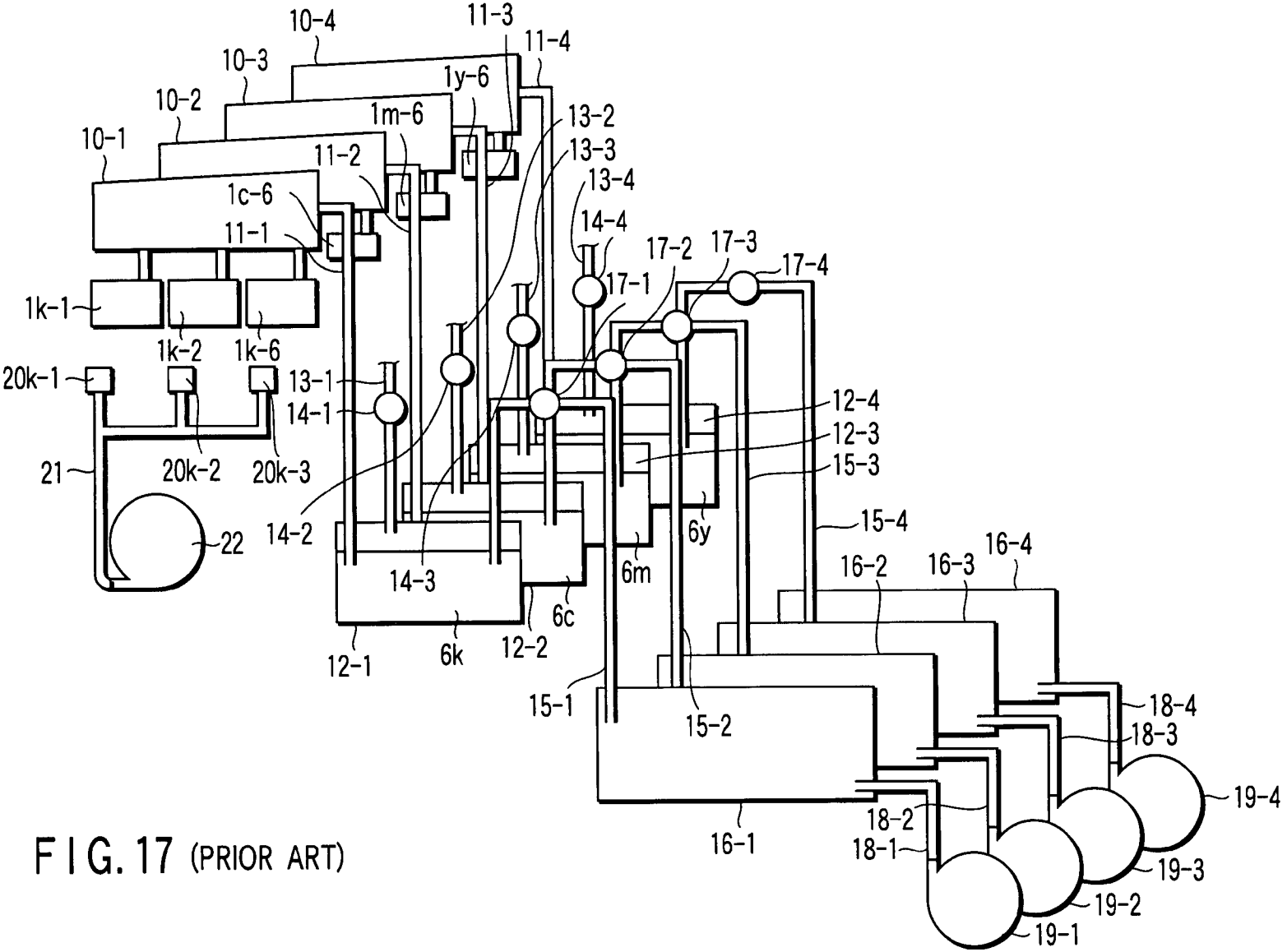
FIG. 17 (PRIOR ART)
FIG. 17 is a constitution diagram for performing maintenance for a conventional image forming apparatus.

A first embodiment of the present invention will be described hereinafter with reference to the drawings. It is to be noted that the same components as those of FIGS. 16 and 17 are denoted with the same reference numerals and detailed description is omitted.

Figure 1:
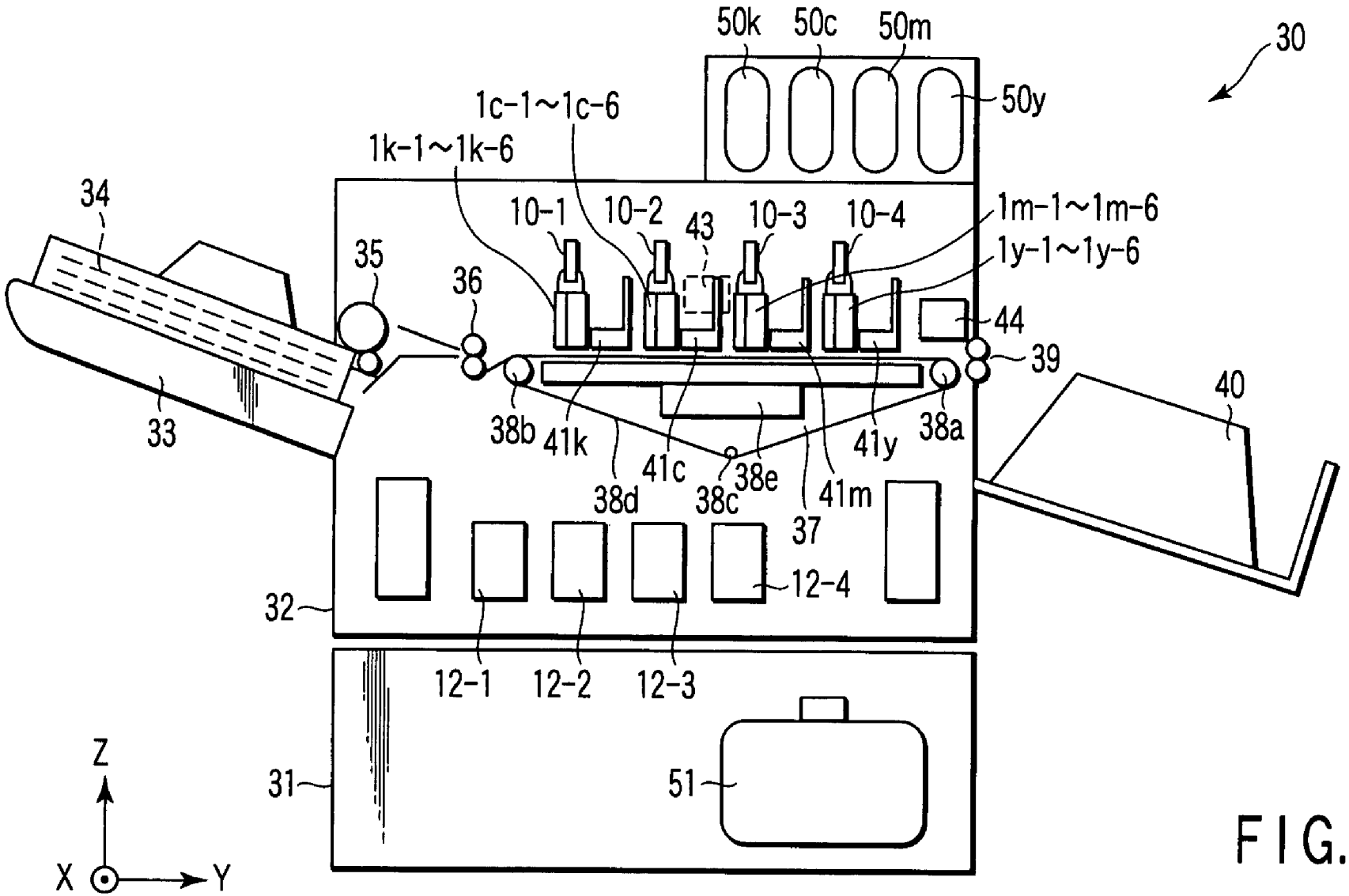
FIG. 1 is a whole constitution diagram showing a first embodiment of an image forming apparatus according to the present invention.

FIG. 1 is a whole constitution diagram of an image forming apparatus. An apparatus main body 30 is constituted of a lower housing 31 and an upper housing 32. A sheet supply tray 33 is detachably attached to one side surface of the upper housing 32. A plurality of image forming mediums 34 are stored in the sheet supply tray 33. A pickup roller 35 is disposed in a sheet supply end portion of the sheet supply tray 33. The pickup roller 35 supplies the image forming mediums 34 stored in the sheet supply tray 33 to the upper housing 32 sheet by sheet.

A pair of registration rollers 36 are disposed in a sheet supply path from the sheet supply tray 33 in the upper housing 32. The registration roller pair 36 supplies the image forming mediums 34 supplied from the sheet supply tray 33 to a belt platen 37 at a predetermined conveying speed.

The belt platen 37 has three platen rollers 38*a*, 38*b*, 38*c*, and an endless band-shaped conveying belt 38*d*. The conveying belt 38*d* is extended over the platen rollers 38*a*, 38*b*, 38*c*.

The platen roller 38*a* among the platen rollers 38*a*, 38*b*, 38*c* is a driving roller. An air suction portion 38*e* is disposed between the platen rollers 38*a*, 38*b*. The belt platen 37 adsorbs the supplied image forming medium 34 onto the conveying belt 38*d* by air suction of the air suction portion 38*e*. The belt platen 37 conveys the image forming medium 34 in a Y-direction at a predetermined conveying speed, when the platen roller 38*a* is driven.

A discharge roller pair 39 is disposed on a sheet discharge path from the belt platen 37 in the upper housing 32. A sheet discharge tray 40 is detachably attached to the other side surface of the upper housing 32. The image forming medium 34 which is discharged from the discharge roller pair 39 and on which an image has been formed is accommodated in the sheet discharge tray 40.

Ink jet heads 1*k*-1 to 1*y*-6 of colors are disposed above the belt platen 37. The ink jet heads 1*k*-1 to 1*y*-6 are disposed at a predetermined interval in the Y-direction for each of the colors (K, C, M, Y). A plurality of, for example, six ink jet heads 1*k*-1 to 1*k*-6 of color K are arranged horizontally alternately in a staggered form in an X-axis direction. Similarly, as to the ink jet heads 1*c*-1 to 1*c*-6, 1*m*-1 to 1*m*-6, 1*y*-1 to 1*y*-6 of colors C, M, Y, a plurality of, for example, six heads of each color are similarly arranged horizontally alternately in the staggered form in the X-axis direction.

The ink jet heads 1*k*-1 to 1*y*-6 are juxtaposed, while back surfaces of two ink head units are disposed facing each other. In two ink head units, a plurality of nozzles 2 which jet inks 6*k* to 6*y* are arranged. Distributors 10-1 to 10-4 for the respective colors are arranged on and connected to the ink jet heads 1*k*-1 to 1*y*-6.

Figure 2:
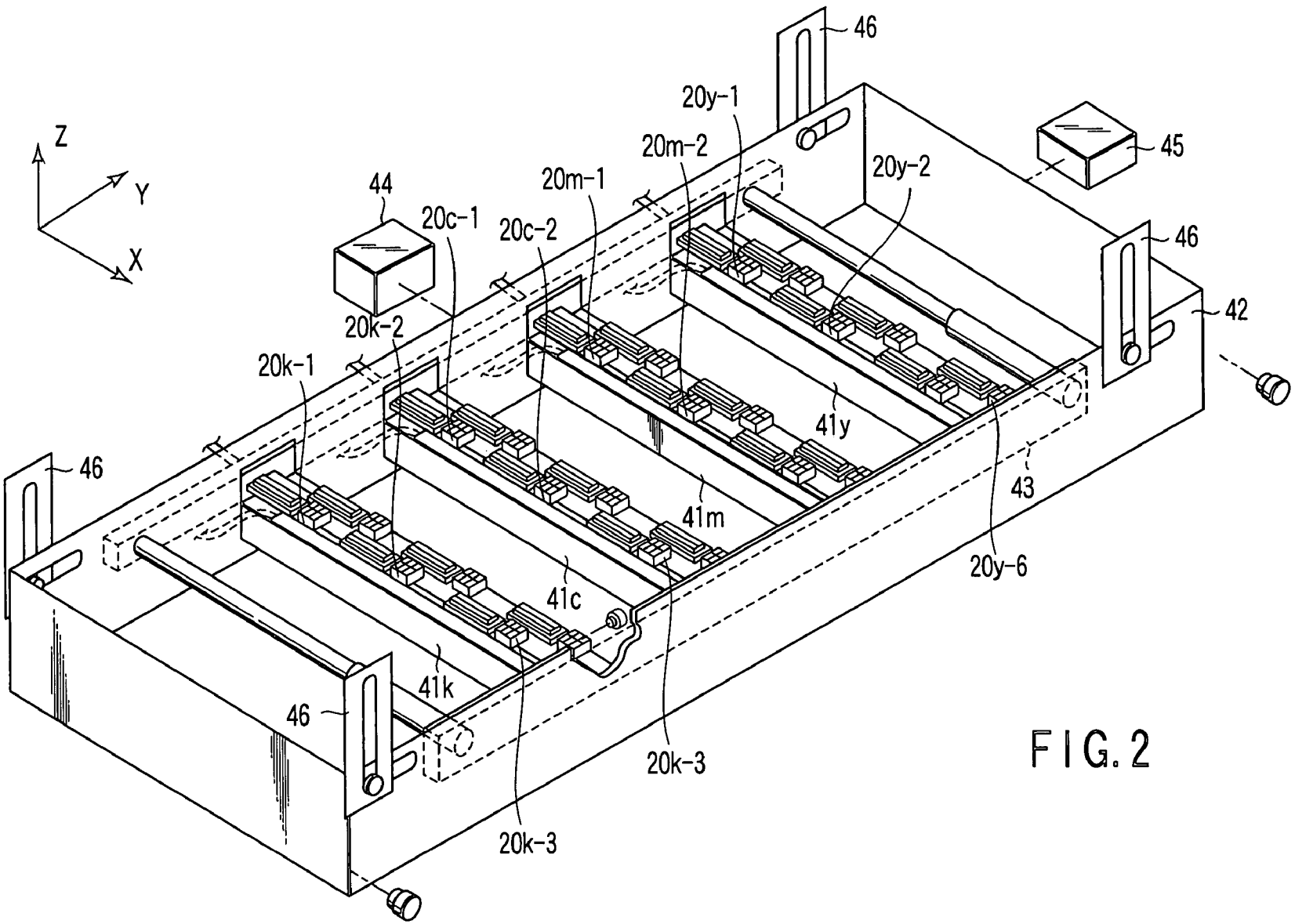
FIG. 2 is a constitution diagram of a maintenance unit in the apparatus.

Ink pans 41*k*, 41*c*, 41*m*, 41*y* for the respective colors are disposed beside side surfaces of the ink jet heads 1*k*-1 to 1*y*-6. As shown in FIG. 2, the ink pans 41*k* to 41*y* are connected to a maintenance carriage 43 in a maintenance unit 42.

An X-direction driving mechanism 44 and a Y-direction driving mechanism 45 are disposed in the maintenance unit 42. The X-direction driving mechanism 44 moves the maintenance unit 42 in an X-direction. The Y-direction driving mechanism 45 moves the maintenance unit 42 in the Y-direction.

Each guide 46 of a Z-axis direction is disposed in each corner portion of the maintenance unit 42. The maintenance unit 42 is guided by the guides 46 to thereby move in the Z-axis direction in response to movement (vertical movement) of the belt platen 37 in the Z-direction.

Cleaning members 20*k*-1 to 20*y*-6 are disposed on the ink pans 41*k*, 41*c*, 41*m*, 41*y*. It is to be noted that in FIG. 2, reference numerals are complicated, and therefore description of all the reference numerals is omitted. The cleaning members 20*k*-1 to 20*y*-6 are arranged facing arrangement positions of the ink jet heads 1*k*-1 to 1*y*-6, and a plurality of, for example, six members are horizontally alternately arranged in the staggered form in the X-axis direction for each color.

Figure 3:
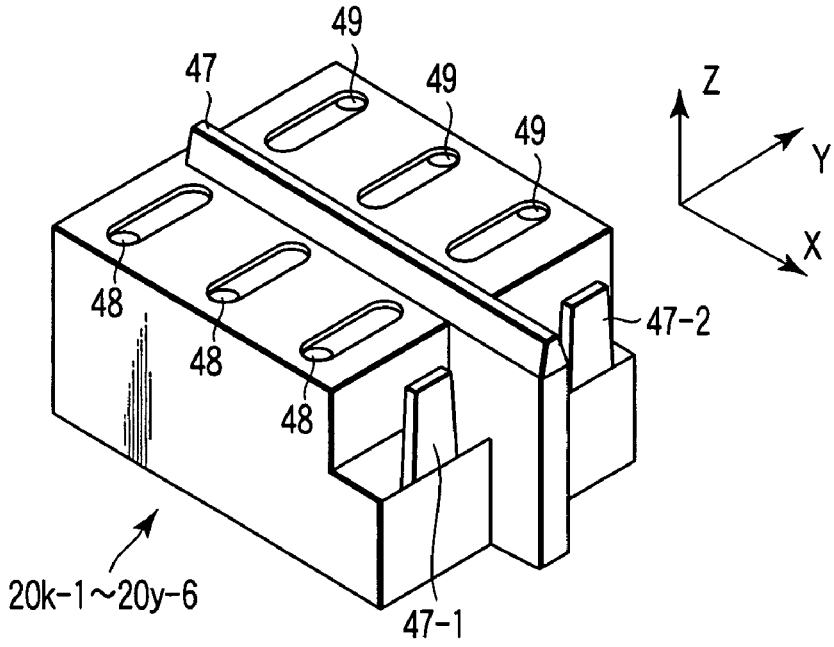
FIG. 3 is a constitution diagram of a cleaning member in the apparatus.

As shown in FIG. 3, in each of the cleaning members 20*k*-1 to 20*y*-6, wiping blades 47-1, 47-2 are arranged on opposite sides of a convex portion 47, and a plurality of suction nozzles 48, 49 are disposed.

The respective ink jet heads 1*k*-1 to 1*y*-6 are juxtaposed, while back surfaces of two ink head units are disposed facing each other. Accordingly, the convex portion 47 is inserted between two ink head units. The wiping blade 47-1 is brought into contact with one ink head unit. Moreover, air is sucked with respect to one ink head unit by a plurality of suction nozzles 48. The wiping blade 47-2 is simultaneously brought into contact with the other ink head unit. Furthermore, air is sucked with respect to the other ink head unit by a plurality of suction nozzles 49.

Ink bottles 50*k*, 50*c*, 50*m*, 50*y* for the respective colors are disposed on the upper housing 32. Ink tanks 12-1 to 12-4 for the colors are disposed in a lower part of the upper housing 32. A waste liquid bottle 51 is disposed in the lower housing 31.

Figure 4:
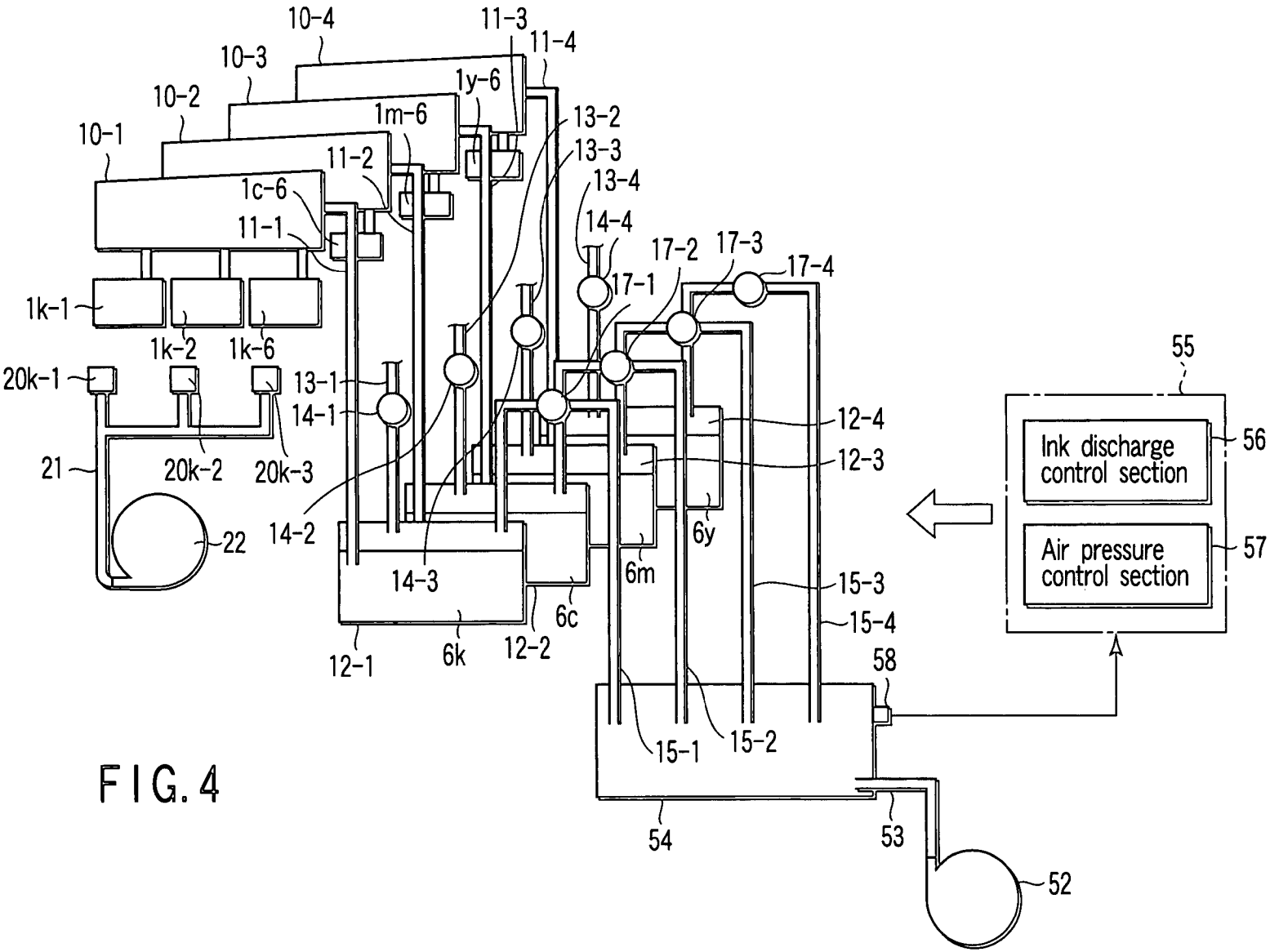
FIG. 4 is a constitution diagram of an ink supply system in the apparatus.

FIG. 4 is a constitution diagram of an ink supply system of the inks 6*k* to 6*y* of the respective colors. One pressurizing pump 52 is connected to one air tank 54 via one pressurizing tube 53. Communication tubes 15-1 to 15-4 are connected between the air tank 54 and the ink tanks 12-1 to 12-4.

An image forming control unit 55 performs a series of operation control while forming an image on the image forming medium 34. That is, the image forming control unit 55 picks up the image forming mediums 34 stored in the sheet supply tray 33 sheet by sheet by the pickup roller 35, and supplies the medium into the upper housing 32.

The image forming control unit 55 adjusts a timing of the supplied image forming medium 34 by the registration roller pair 36 when conveying the medium to the belt platen 37.

The image forming control unit 55 adsorbs the image forming medium 34 onto the conveying belt 38*d* by air suction by the air suction portion 38*e*. In this state, the image forming control unit 55 drives the belt platen 37, and conveys the image forming medium 34 in the Y-direction at a predetermined conveying speed. At this time, the image forming control unit 55 jets the respective inks 6*k*, 6*c*, 6*m*, 6*y* of the colors (K, C, M, Y) from the ink jet heads 1*k*-1 to 1*y*-6 to thereby form an image on the image forming medium 34.

The image forming control unit 55 discharges the image forming medium 34 on which the image has been formed into the sheet discharge tray 40 through the discharge roller pair 39.

The image forming control unit 55 has an ink discharge control section 56 and an air pressure control section 57 for controlling normal maintenance operations of the ink jet heads 1*k*-1 to 1*y*-6. The ink discharge control section 56 inputs a pressure detection signal output from a pressure sensor 58 disposed in the air tank 54, and detects whether or not the pressure in the air tank 54 reaches a purge pressure.

When the ink discharge control section 56 detects that the pressure in the air tank 54 reaches the purge pressure, pressurizing valves 17-1 to 17-4 are opened, and air is supplied to the ink tanks 12-1 to 12-4 from the air tank 54 through the pressurizing valves 17-1 to 17-4. Furthermore, the ink discharge control section 56 supplies pressure by the air to the ink jet heads 1*k*-1 to 1*y*-6 through the distributors 10-1 to 10-4.

Accordingly, head inner pressures of the ink jet heads 1*k*-1 to 1*y*-6 rise, and the inks 6*k* to 6*y* of the colors are discharged from the ink jet heads 1*k*-1 to 1*y*-6.

The air pressure control section 57 maintains the openings of the pressurizing valves 17-1 to 17-4 at the end of a purge period. Moreover, the air pressure control section 57 opens the atmosphere open valves 14-1 to 14-4 connected to the ink tanks 12-1 to 12-4 a plurality of times, for example, intermittently twice. Accordingly, the pressures in the ink tanks 12-1 to 12-4 are reduced, and the pressures in the ink tanks 12-1 to 12-4 are averaged.

Next, a normal maintenance operation of the apparatus constituted as described above will be described.

Figure 5:
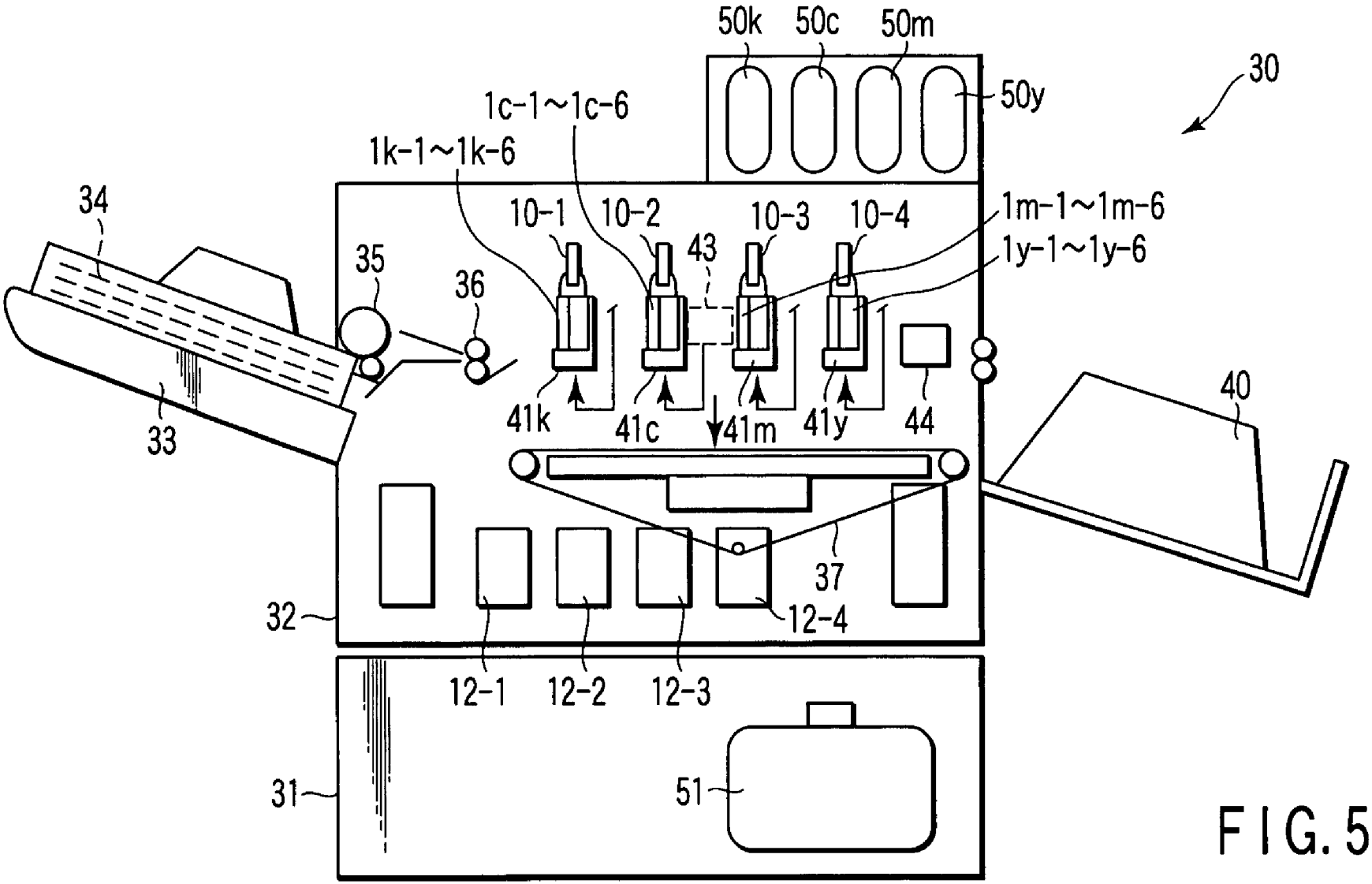
FIG. 5 is a diagram showing moved positions of a belt platen and ink pans at a maintenance start time in the apparatus.

As shown in FIG. 5, at the start of normal maintenance, the belt platen 37 lowers in a Z-direction. The maintenance unit 42 is guided by the guides 46 to thereby move downwards in the Z-axis direction in response to the lowering of the belt platen 37 in the Z-direction.

Next, the Y-direction driving mechanism 45 moves the maintenance unit 42 in the Y-direction along a sheet supply side of the image forming medium 34. Accordingly, the cleaning members 20*k*-1 to 20*y*-6 on the ink pans 41*k*, 41*c*, 41*m*, 41*y* in the maintenance unit 42 are arranged under the ink jet heads 1*k*-1 to 1*y*-6 in such a manner as to face the heads.

In an initial state of the normal maintenance, the pressurizing pump 52 stops, the pressurizing valves 17-1 to 17-4 are closed, and the atmosphere open valves 14-1 to 14-4 are opened. Accordingly, back pressures are applied to the ink chambers 5 of the ink jet heads 1*k*-1 to 1*y*-6 through the ink tanks 12-1 to 12-4. The meniscuses 7 are formed in the nozzles 2 of the ink jet heads 1*k*-1 to 1*y*-6. The cleaning members 20*k*-1 to 20*y*-6 are positioned below the ink jet heads 1*k*-1 to 1*y*-6.

Figure 6:
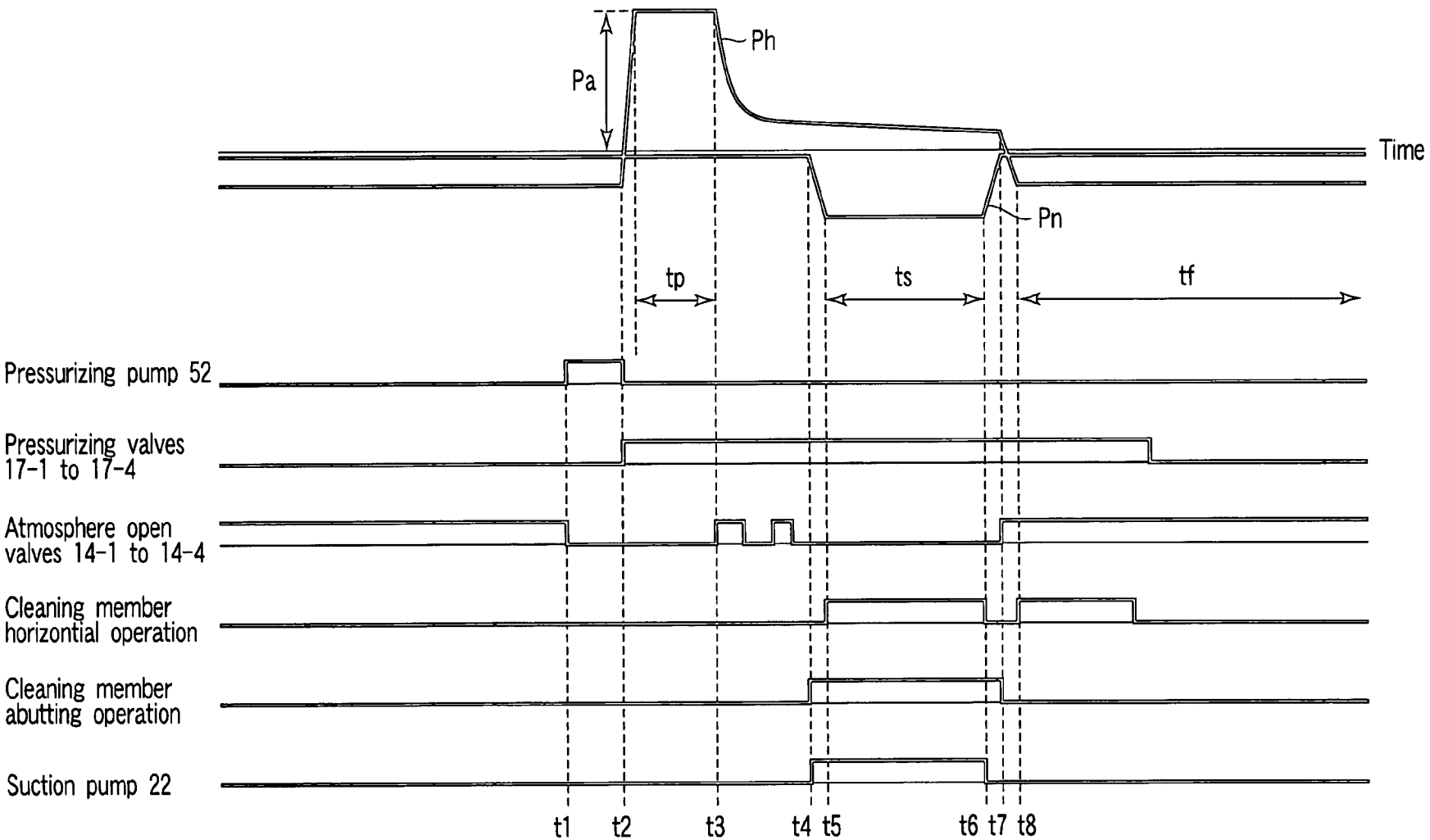
FIG. 6 is a timing chart of normal maintenance in the apparatus.

Next, the normal maintenance will be described with reference to a timing chart of FIG. 6.

The ink discharge control section 56 issues a driving command to the pressurizing pump 52 at a time $t_1$, and issues closing commands to the atmosphere open valves 14-1 to 14-4. When the pressurizing pump 52 is driven, the air is supplied into the air tank 54 through the pressurizing tube 53. At this time, the pressurizing valves 17-1 to 17-4 are all closed.

Accordingly, the pressure in the air tank 54 rises. The pressure sensor 58 detects the pressure in the air tank 54, and outputs a pressure detection signal. The pressure detection signal is sent to the image forming control unit 55.

When the pressure in the air tank 54 reaches a pressure (head inner pressure Pa reaches, for example, 10 KPa) required for normal purge at a time $t_2$, the ink discharge control section 56 issues a stop command to the pressurizing pump 52 at the time $t_2$, and also issues open commands to all the pressurizing valves 17-1 to 17-4.

When the pressurizing valves 17-1 to 17-4 are opened, the pressure in the air tank 54 is applied to the ink tanks 12-1 to 12-4 through the pressurizing valves 17-1 to 17-4. At this time, the atmosphere open valves 14-1 to 14-4 are closed.

Accordingly, the pressures in the ink tanks 12-1 to 12-4 rise. Because of the rises of pressure in the ink tanks 12-1 to 12-4, the inks 6*k*, 6*c*, 6*m*, 6*y* of the colors stored in the ink tanks 12-1 to 12-4 are supplied to the distributors 10-1 to 10-4 through the tubes 11-1 to 11-4. Furthermore, the inks 6*k*, 6*c*, 6*m*, 6*y* are supplied to the ink jet heads 1*k*-1 to 1*y*-6.

Accordingly, as to a head inner pressure Ph of each of the ink jet heads 1*k*-1 to 1*y*-6, for example, a purge pressure Pa of 3K to 20 KPa is applied, and the inks 6*k*, 6*c*, 6*m*, 6*y* are discharged from the nozzles 2. When the inks 6*k*, 6*c*, 6*m*, 6*y* are discharged, bubbles, foreign matters and the like in the nozzles 2 and ink chambers 5 are discharged. The inks 6*k*, 6*c*, 6*m*, 6*y* discharged from the nozzles 2 are discharged to the waste liquid bottle 51.

The inks 6*k*, 6*c*, 6*m*, 6*y* are discharged for a normal purge period tp. The image forming control unit 55 measures the purge period tp by an inner timer, and set the period, for example, to about 0.3 to 20 seconds, preferably about 0.5 to 5 seconds.

When the purge period tp elapses, the image forming control unit 55 issues open commands to all the atmosphere open valves 14-1 to 14-4 at a time $t_3$. Accordingly, all the atmosphere open valves 14-1 to 14-4 are opened. The pressures in the ink tanks 12-1 to 12-4 drop. As a result, the pressures in the nozzles 2 and ink chambers 5 of the ink jet heads 1*k*-1 to 1*y*-6 drop.

The pressures in the nozzles 2 and ink chambers 5 of the ink jet heads 1*k*-1 to 1*y*-6 drop in this manner. Additionally, the reduced pressures in the nozzle 2 and ink chamber 5 are set to micro-positive pressures to such an extent that the inks 6*k*, 6*c*, 6*m*, 6*y* do not drip from the nozzles 2 of the ink jet heads 1*k*-1 to 1*y*-6. This micro-positive pressure is, for example, about 0.1K to 3 KPa.

When the pressures in the ink tanks 12-1 to 12-4 substantially drop to positive pressures at a sucking time, that is, micro-positive pressure, the atmosphere open valves 14-1 to 14-4 are closed. When the atmosphere open valves 14-1 to 14-4 are only opened/closed once to thereby reduce the pressures in the ink tanks 12-1 to 12-4 to the micro-positive pressures, the pressures in the ink tanks 12-1 to 12-4 rapidly change. Moreover, the pressures in the ink chambers 5 of the ink jet heads 1*k*-1 to 1*y*-6 also rapidly change.

Therefore, when the respective atmosphere open valves 14-1 to 14-4 are closed, the pressures in the ink chambers 5 of the ink jet heads 1*k*-1 to 1*y*-6 temporarily fall to negative pressures from the positive pressures, again return to positive pressures, and cause undershoot in this manner by rapid pressure changes. The larger the pressure change in the ink chamber 5 is, the larger the drop to the negative pressure by this undershoot becomes.

When the pressure in the ink chamber 5 temporarily falls to the negative pressure from the positive pressure, an ink liquid level moves between the nozzle 2 and the ink chamber 5 in the nozzle 2 of each of the ink jet heads 1*k*-1 to 1*y*-6. This has a possibility that the air is involved into each ink chamber 5.

To solve the problem, the air pressure control section 57 issues a command to intermittently open all the atmosphere open valves 14-1 to 14-4 a plurality of times, for example, twice in a period from time $t_3$ till $t_4$. Accordingly, all the atmosphere open valves 14-1 to 14-4 are simultaneously brought into the open states intermittently twice.

As a result, even when the pressure in the ink chamber 5 of each of the ink jet heads 1*k*-1 to 1*y*-6 falls in a short period, the pressure changes in the ink tanks 12-1 to 12-4 at a time when the atmosphere open valves 14-1 to 14-4 are closed are reduced. The pressure in each ink chamber 5 is inhibited from being brought into the negative pressure.

On the other hand, the atmosphere open valves 14-1 to 14-4 have large fluctuations of performances for each product. Therefore, for example, even when the atmosphere open valves 14-1 to 14-4 receive open commands at the same timing, the valves do not necessarily open simultaneously because of an electrical or mechanical delay. The atmosphere open valves 14-1 to 14-4 open at different timings.

The fluctuations of the open timings of the atmosphere open valves 14-1 to 14-4 cause fluctuations in the pressures in the ink tanks 12-1 to 12-4.

On the other hand, the air pressure control section 57 opens all the atmosphere open valves 14-1 to 14-4, and also opens all the pressurizing valves 17-1 to 17-4 in the period from time $t_3$ till $t_4$. Accordingly, all the ink tanks 12-1 to 12-4 communicate with the air tank 54. As a result, inner pressures of all the ink tanks 12-1 to 12-4 and the air tank 54 are averaged.

Therefore, when the respective atmosphere open valves 14-1 to 14-4 open at different timings, the fluctuations in the pressures in the ink tanks 12-1 to 12-4 are reduced by the averaging of the inner pressures of the ink tanks 12-1 to 12-4 and the air tank 54 by communication of all the ink tanks 12-1 to 12-4 with the air tank 54. When the inner pressures of the ink tanks 12-1 to 12-4 and the inner pressure of the air tank 54 are averaged, the pressures in the nozzles 2 and ink chambers 5 of the ink jet heads 1*k*-1 to 1*y*-6 are easily set to predetermined micro-positive pressures.

When the pressures in the nozzles 2 and ink chambers 5 of the ink jet heads 1*k*-1 to 1*y*-6 are set to micro-positive pressures, the image forming control unit 55 positions the cleaning members 20*k*-1 to 20*y*-6 with respect to the ink jet heads 1*k*-1 to 1*y*-6 shown in FIG. 5 at the time $t_4$. Next, the image forming control unit 55 allows the cleaning members 20*k*-1 to 20*y*-6 to abut on the ink jet heads 1*k*-1 to 1*y*-6.

Moreover, the image forming control unit 55 issues a suction command to the suction pump 22 at the time $t_4$. Accordingly, the cleaning members 20*k*-1 to 20*y*-6 starts suction by the suction nozzles 48, 49 shown in FIG. 3.

Negative pressures Pn are applied to the respective cleaning members 20*k*-1 to 20*y*-6 by air suction of the suction pump 22. When the negative pressures Pn applied to the cleaning members 20*k*-1 to 20*y*-6 are stabilized at predetermined values, the image forming control unit 55 issues a driving command to the X-direction driving mechanism 44 at time $t_5$. Accordingly, the maintenance unit 42 moves in an X-direction, that is, horizontal direction (or a nozzle arrangement direction) in a sucking period ts.

The respective cleaning members 20*k*-1 to 20*y*-6 slide over the whole nozzle plates 3 of the ink jet heads 1*k*-1 to 1*y*-6. The cleaning members 20*k*-1 to 20*y*-6 suck the inks 6*k*, 6*c*, 6*m*, 6*y* attached onto the nozzle plates 3 of the ink jet heads 1*k*-1 to 1*y*-6. Moreover, the cleaning members 20*k*-1 to 20*y*-6 scrape and remove deposits sticking to the nozzle plates 3.

At this time, the respective cleaning members 20*k*-1 to 20*y*-6 suck the inks 6*k*, 6*c*, 6*m*, 6*y* gradually discharged from the nozzles of the ink jet heads 1*k*-1 to 1*y*-6 and accumulated on the nozzle plates 3 of the ink jet heads 1*k*-1 to 1*y*-6 because of the applied micro-positive pressure. Accordingly, the ink liquid level does not move between each nozzle 2 and the ink chamber 5, or any air is not involved in the ink chamber 5.

The image forming control unit 55 issues a stop command to the X-direction driving mechanism 44, and also issues a stop command to the suction pump 22 at time $t_6$ when the sucking period ts ends.

Next, the image forming control unit 55 moves down the cleaning members 20*k*-1 to 20*y*-6 to thereby detach the members from the ink jet heads 1*k*-1 to 1*y*-6 at a time $t_7$ when a leaving period tf starts.

The image forming control unit 55 issues an open command to the atmosphere open valves 14-1 to 14-4 at the time $t_7$. The atmosphere open valves 14-1 to 14-4 open. The atmosphere open valves 14-1 to 14-4 are left in the opened states.

Accordingly, the back pressures are applied into the ink chambers 5 of the ink jet heads 1*k*-1 to 1*y*-6. The meniscuses 7 are formed in the nozzles 2 of the ink jet heads 1*k*-1 to 1*y*-6. Thus, the ink jet heads 1*k*-1 to 1*y*-6 return to image formable states.

Thereafter, the maintenance unit 42 moves backwards in the X-direction, and returns to its original position at time $t_8$. When the pressure in the air tank becomes equal to an atmospheric pressure, the pressurizing valves 17-1 to 17-4 are closed, and the state returns to an initial state.

As described above, according to the first embodiment, the pressurizing pump 52 is connected to the air tank 54 via the pressurizing tube 53, and the air tank 54 is connected to the ink tanks 12-1 to 12-4 via the pressurizing valves 17-1 to 17-4. After the purge period tp, all the atmosphere open valves 14-1 to 14-4 are opened, and all the pressurizing valves 17-1 to 17-4 are also opened.

As a result, all the ink tanks 12-1 to 12-4 communicate with the air tank 54, and the inner pressures of the ink tanks 12-1 to 12-4 and the inner pressure of the air tank 54 are averaged.

Accordingly, the fluctuations of the performances of the atmosphere open valves 14-1 to 14-4 are large for each product. For example, even when the open commands are issued at the same timing, the valves do not simultaneously open because of the electrical or mechanical delay or the like. Even when the valves open at different timings, the pressures of the ink tanks 12-1 to 12-4 can be averaged.

Therefore, when the inner pressures of the ink tanks 12-1 to 12-4 and the inner pressure of the air tank 54 are averaged, the pressures in the nozzles 2 and ink chambers 5 of the ink jet heads 1*k*-1 to 1*y*-6 are easily set to the micro-positive pressures.

As a result, when the back pressures are applied into the ink chambers 5 of the ink jet heads 1*k*-1 to 1*y*-6, the satisfactory meniscuses 7 can be formed in the nozzles 2. Amounts of the inks 6*k*, 6*c*, 6*m*, 6*y* jetted from the nozzles 2 at an image forming time can be set to appropriate amounts. The jet directions of the inks 6*k*, 6*c*, 6*m*, 6*y* can be set to appropriate directions. A high-quality image can be formed.

Next, a second embodiment of the present invention will be described with reference to the drawings. It is to be noted that the same components as those of FIGS. 1 to 5 are denoted with the same reference numerals, detailed description thereof is omitted, and different parts will be described.

When nozzle missing occurs in a certain nozzle 2 among nozzles 2 of ink jet heads 1*k*-1 to 1*y*-6 in a fixed manner in the first embodiment, the nozzle missing cannot be recovered in some case in normal maintenance described in the first embodiment.

In this case, maintenance (referred to as strong maintenance) having a higher head inner pressure Ph needs to be performed with respect to the certain nozzle 2 of the ink jet heads 1*k*-1 to 1*y*-6.

Figure 7:
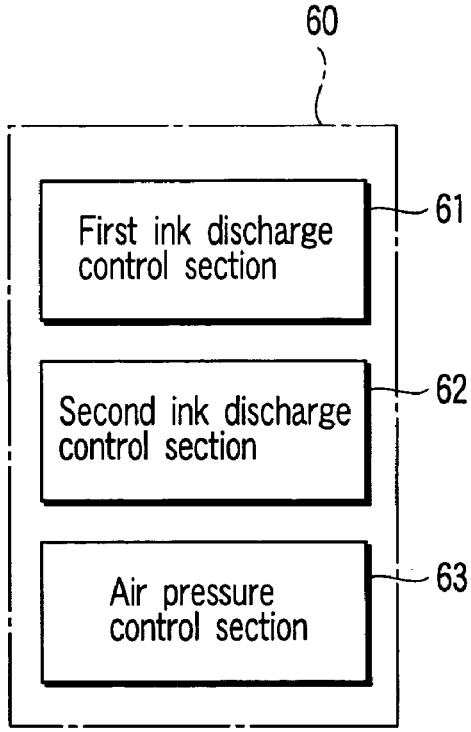
FIG. 7 is a constitution diagram of an image forming control unit showing a second embodiment of the image forming apparatus according to the present invention.

In the present embodiment, the strong maintenance is performed. FIG. 7 is a constitution diagram of an image forming control unit in the present image forming apparatus. An image forming control unit 60 controls a series of image forming operations with respect to an image forming medium 34, and performs a control operation of the strong maintenance.

The image forming control unit 60 has a first ink discharge control section 61, a second ink discharge control section 62, and an air pressure control section 63 for controlling a strong maintenance operation for the ink jet heads 1*k*-1 to 1*y*-6.

The first ink discharge control section 61 opens an only pressurizing valve 17-1 corresponding to one desired color, for example, K color among pressurizing valves 17-1 to 17-4, and supplies air to an only ink tank 12-1 corresponding to the K color which is one desired color from a pressurizing pump 52 through an air tank 54.

The first ink discharge control section 61 supplies the air only into the ink tank 12-1, and raises an head inner pressure to each head inner pressure Pg in the ink jet heads 1*k*-1 to 1*k*-6 of the K color from the ink tank 12-1 through the distributor 10-1.

The first ink discharge control section 61 raises the head inner pressure to the head inner pressure Pg of each of the ink jet heads 1*k*-1 to 1*k*-6 of the K color, and strongly discharges the ink 6*k* of the K color which is one required color from the ink jet heads 1*k*-1 to 1*k*-6. The strong maintenance is performed.

The second ink discharge control section 62 opens the pressurizing valves 17-2 to 17-4 corresponding to colors other than the K color which is one required color, for example, C, M, Y colors among the pressurizing valves 17-1 to 17-4, and supplies the air into the ink tanks 12-2 to 12-4 corresponding to the C, M, Y colors which are the other colors from the pressurizing pump 52 through the air tank 54.

The second ink discharge control section 62 supplies the air into the ink tanks 12-2 to 12-4, and raises a head inner pressure Ph of each of the ink jet heads 1*c*-1 to 1*y*-6 corresponding to the C, M, Y colors which are the other colors from the ink tanks 12-2 to 12-4 through distributors 10-2 to 10-4.

The second ink discharge control section 62 performs normal maintenance to raise the head inner pressures Ph of the ink jet heads 1*c*-1 to 1*y*-6, and discharge inks 6*c*, 6*m*, 6*y* of the C, M, Y colors which are the other colors from the ink jet heads 1*c*-1 to 1*y*-6.

The air pressure control section 63 opens the pressurizing valves 17-1 to 17-4 at the end of a purge period. Moreover, the air pressure control section 63 intermittently opens at least one or more atmosphere open valves 14-1 to 14-4 among the atmosphere open valves 14-1 to 14-4 connected to the ink tanks 12-1 to 12-4 a plurality of times, for example, twice. Moreover, the air pressure control section 63 opens the pressurizing valves 17-1 to 17-4 to thereby average the pressures in the ink tanks 12-1 to 12-4.

Figure 8:
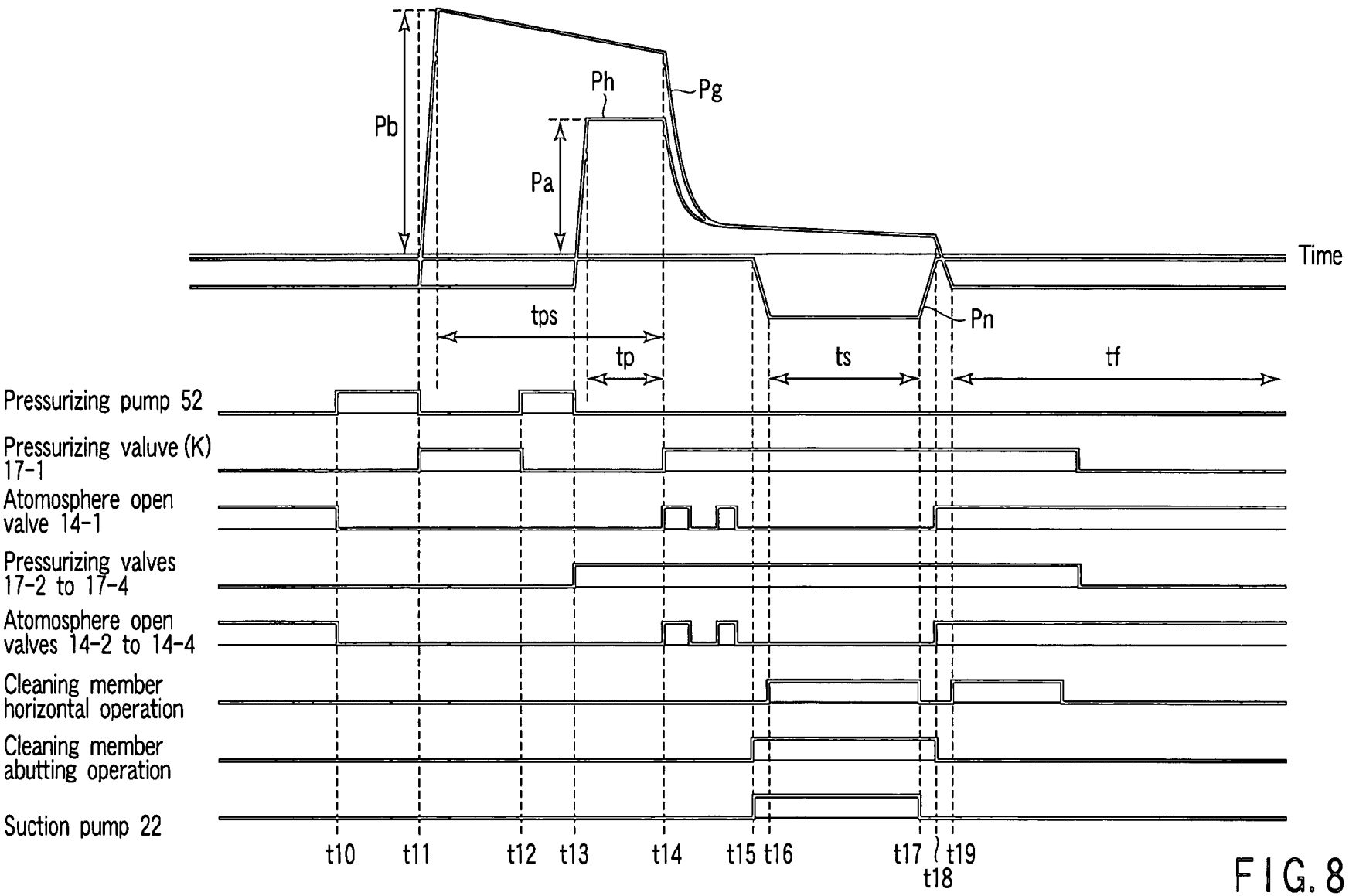
FIG. 8 is a timing chart of strong maintenance in the apparatus.

Next, a strong maintenance operation of the apparatus constituted as described above will be described with reference to a timing chart of the strong maintenance shown in FIG. 8.

At the start of the strong maintenance, as shown in FIG. 5, a maintenance unit 42 is guided by guides 46 to thereby move downwards in a Z-axis direction in response to downward movement of a belt platen 37 in the Z-direction. The maintenance unit 42 moves on a sheet supply side of an image forming medium 34 by operation of a Y-direction driving mechanism 45. Accordingly, cleaning members 20*k*-1 to 20*y*-6 are arranged facing and under the ink jet heads 1*k*-1 to 1*y*-6.

The first ink discharge control section 61 issues a driving command to a pressurizing pump 52, and issues close commands to the atmosphere open valves 14-1 to 14-4 at a time $t_{10}$. The pressurizing pump 52 is driven to thereby supply air into an air tank 54 through a pressurizing tube 53. Accordingly, the pressure in the air tank 54 rises.

When the pressure in the air tank 54 reaches a purge pressure (pressure to such an extent that a pressure Pg applied into the head corresponds to Pb) required for strong purge at a time $t_{11}$, the first ink discharge control section 61 issues a stop command to the pressurizing pump 52 at the time $t_{11}$. Moreover, the first ink discharge control section 61 issues an open command only to the pressurizing valve 17-1 corresponding to one required color in which nozzle missing has occurred, for example, K color. It is to be noted that when the color having the nozzle missing is C color, the only pressurizing valve 17-2 corresponding to the C color is opened.

When the pressurizing valve 17-1 is opened in a period from the time $t_{11}$ till time $t_{12}$, a pressure required for the strong purge in the air tank 54 is applied only to the ink tank 12-1 through the pressurizing valve 17-1.

At this time, since the atmosphere open valves 14-1 to 14-4 close, the pressure in the ink tank 12-1 rises. The ink 6*k* of K color stored in the ink tank 12-1 is supplied to the distributor 10-1 through a tube 11-1 by the rise of the pressure. Furthermore, the ink 6*k* of the K color is supplied to the ink jet heads 1*k*-1 to 1*k*-6.

Accordingly, the ink 6*k* is strongly discharged from the nozzles 2 of the ink jet heads 1*k*-1 to 1*k*-6 by a purge pressure Pb (e.g., 20K to 50 KPa).

When the ink 6*k* is discharged, bubbles, foreign matters and the like in the nozzles 2 and ink chambers 5 are discharged, and the nozzle missing can be recovered. The ink 6*k* discharged from each nozzle 2 is discharged to a waste liquid bottle 51.

Next, the second ink discharge control section 62 closes the pressurizing valve 17-1, and issues a driving command to the pressurizing pump 52 at a time $t_{12}$. When the pressurizing pump 52 is driven, the air is supplied into the air tank 54 through the pressurizing tube 53. Accordingly, the pressure in the air tank 54 rises.

When the pressure in the air tank 54 reaches a purge pressure required for normal pure at a time $t_{13}$, the second ink discharge control section 62 issues a stop command to the pressurizing pump 52 at the time $t_{13}$, and issues an open command to the pressurizing valves 17-2 to 17-4 corresponding to colors other than the K color, that is, C, M, Y colors.

When the pressurizing valves 17-2 to 17-4 are opened, the pressure in the air tank 54 is applied to the ink tanks 12-2 to 12-4 through the pressurizing valves 17-2 to 17-4. When the pressures in the ink tanks 12-2 to 12-4 rise, inks 6*c*, 6*m*, 6*y* of the colors stored in the ink tanks 12-2 to 12-4 are supplied to the distributors 10-2 to 10-4 through tubes 11-2 to 11-4. Furthermore, the inks 6*c*, 6*m*, 6*y* are supplied to the ink jet heads 1*c*-1 to 1*y*-6. Accordingly, a purge pressure Pa is applied to each of the ink jet heads 1*c*-1 to 1*y*-6.

Accordingly, the respective inks 6*c*, 6*m*, 6*y* are discharged from the nozzles 2 of the ink jet heads 1*c*-1 to 1*y*-6 corresponding to the C, M, Y colors. When the inks 6*c*, 6*m*, 6*y* are discharged, bubbles, foreign matters and the like in the nozzles 2 and ink chambers 5 are discharged. The inks 6*c*, 6*m*, 6*y* discharged from the nozzles 2 are discharged to the waste liquid bottle 51.

At a time $t_{14}$ after elapse of a strong purge period tps and normal purge period tp, the air pressure control section 63 issues a command to maintain open states with respect to all the pressurizing valves 17-1 to 17-4 at the time $t_{14}$.

The air pressure control section 63 issues a command to intermittently open all the atmosphere open valves 14-1 to 14-4 a plurality of times, for example, twice in a period from the time $t_{14}$ till time $t_{15}$. Accordingly, all the atmosphere open valves 14-1 to 14-4 intermittently open a plurality of times, for example, twice simultaneously, and all the pressurizing valves 17-1 to 17-4 maintain open states.

Accordingly, in the same manner as in the first embodiment, pressure changes in the ink tanks 12-1 to 12-4 at a time when the atmosphere open valves 14-1 to 14-4 close decrease. The pressure in each ink chamber 5 does not turn to a negative pressure.

On the other hand, the pressure in the ink tank 12-1 is higher than the pressures in the other ink tanks 12-2 to 12-4 by the strong maintenance. The air pressure control section 63 opens the atmosphere open valves 14-1 to 14-4 as described above, and also opens all the pressurizing valves 17-1 to 17-4. Accordingly, all the ink tanks 12-1 to 12-4 communicate with the air tank 54.

Additionally, even when a difference is made between the pressure in the ink tank 12-1 and the pressures in the other ink tanks 12-2 to 12-4, the respective inner pressures of all the ink tanks 12-1 to 12-4 and the inner pressure of the air tank 54 are averaged.

As a result, fluctuations of the pressures in the ink tanks 12-1 to 12-4 are averaged by communication of all the ink tanks 12-1 to 12-4 with the air tank 54. When the inner pressures of the ink tanks 12-1 to 12-4 and the inner pressure of the air tank 54 are averaged, the pressures in the nozzles 2 and ink chambers 5 of the ink jet heads 1*k*-1 to 1*y*-6 are easily set to micro-positive pressure.

Moreover, fluctuations of performances of the atmosphere open valves 14-2 to 14-4 are large for each product. For example, even when the open commands are received at the same timing, the valves do not simultaneously open because of an electrical or mechanical delay or the like. Even when the pressure difference is produced by the fluctuations of open timings of the atmosphere open valves 14-2 to 14-4, the inner pressures of the ink tanks 12-1 to 12-4 and the inner pressure of the air tank 54 are averaged by the communication of all the ink tanks 12-1 to 12-4 with the air tank 54.

Thereafter, in the same manner as in the first embodiment, the inks 6*k*, 6*c*, 6*m*, 6*y* are slightly discharged from the nozzles 2 of the ink jet heads 1*k*-1 to 1*y*-6. However, the pressures in the nozzle 2 and ink chamber 5 of the ink jet heads 1*k*-1 to 1*y*-6 are set to micro-positive pressures to such an extent that the ink does not drip from the nozzle plate, for example, about 0.1 k to 3 kPa.

Next, the image forming control unit 60 positions the cleaning members 20*k*-1 to 20*y*-6 with respect to the ink jet heads 1*k*-1 to 1*y*-6 at the time $t_{15}$. Moreover, the image forming control unit 60 allows the cleaning members 20*k*-1 to 20*y*-6 to abut on the ink jet heads 1*k*-1 to 1*y*-6.

The image forming control unit 60 issues a suction command to the suction pump 22 at the time $t_{15}$. The cleaning members 20*k*-1 to 20*y*-6 start suction of suction nozzles 48, 49 shown in FIG. 3.

Negative pressures Pn are applied to the cleaning members 20*k*-1 to 20*y*-6 by air suction of the suction pump 22. When the negative pressures Pn applied to the cleaning members 20*k*-1 to 20*y*-6 are stabilized at predetermined values, the image forming control unit 55 issues a driving command to an X-direction driving mechanism 44 at a time $t_{16}$.

Accordingly, the maintenance unit 42 moves in an X-direction (nozzle arrangement direction) in a sucking period ts. Accordingly, the cleaning members 20*k*-1 to 20*y*-6 slide over the whole nozzle plates 3 of the ink jet heads 1*k*-1 to 1*y*-6. The cleaning members 20*k*-1 to 20*y*-6 scrape and suck the inks 6*k*, 6*c*, 6*m*, 6*y* discharged onto the nozzle plates 3 of the ink jet heads 1*k*-1 to 1*y*-6. Moreover, the cleaning members 20*k*-1 to 20*y*-6 remove deposits sticking to the nozzle plates 3.

At this time, since the respective cleaning members 20*k*-1 to 20*y*-6 suck the inks 6*k*, 6*c*, 6*m*, 6*y* on the nozzle plates 3 of the ink jet heads 1*k*-1 to 1*y*-6, the ink liquid level does not move between each nozzle 2 and the ink chamber 5. There is not any possibility that the air is involved in the ink chamber 5.

The image forming control unit 55 issues a stop command to an X-direction driving mechanism 44, and also issues a stop command to the suction pump 22 at a time $t_{17}$ when the sucking period ts ends.

Next, the image forming control unit 55 moves down the cleaning members 20*k*-1 to 20*y*-6 to thereby detach the members from the ink jet heads 1*k*-1 to 1*y*-6 at a time $t_{18}$ when a leaving period tf starts. The image forming control unit 55 issues an open command to the atmosphere open valves 14-1 to 14-4 at the time $t_{18}$.

Accordingly, the atmosphere open valves 14-1 to 14-4 open. When the atmosphere open valves 14-1 to 14-4 are left in the opened states, back pressures are applied into the ink chambers 5 of the ink jet heads 1*k*-1 to 1*y*-6. Accordingly, meniscuses 7 are formed in the nozzles 2 of the ink jet heads 1*k*-1 to 1*y*-6. Thus, the ink jet heads 1*k*-1 to 1*y*-6 return to image formable states.

Thereafter, the maintenance unit 42 moves backwards in the X-direction, and returns to its original position at a time $t_{19}$. When the pressure in the air tank becomes equal to an atmospheric pressure, the pressurizing valves 17-1 to 17-4 are closed, and the state returns to an initial state.

As described above, according to the second embodiment, after the elapse of the strong purge period tps and normal purge period tp, all the pressurizing valves 17-1 to 17-4 are opened, and all the atmosphere open valves 14-1 to 14-4 are intermittently opened a plurality of times, for example, twice simultaneously.

Accordingly, when the pressure in the ink tank 12-1 by the purge pressure Pb of the strong purge is different from the pressures in the ink tanks 12-2 to 12-4 by the purge pressure Pa of the normal purge, the ink tanks 12-1 to 12-4 communicate with the air tank 54, and the fluctuations of the pressures in the ink tanks 12-1 to 12-4 can be averaged. As a result, the pressures in the nozzles 2 and ink chambers 5 of the ink jet heads 1*k*-1 to 1*y*-6 are easily set to the micro-positive pressures.

Therefore, when the back pressures are applied into the ink chambers 5 of the ink jet heads 1*k*-1 to 1*y*-6, the satisfactory meniscuses 7 can be formed in the nozzles 2. Amounts of the inks 6*k*, 6*c*, 6*m*, 6*y* jetted from the nozzles 2 at an image forming time can be set to appropriate amounts. The jet directions of the inks 6*k*, 6*c*, 6*m*, 6*y* can be set to appropriate directions. As a result, a high-quality image can be formed.

In the strong maintenance, the air from the pressurizing pump 52 is supplied to the ink jet heads 1*k*-1 to 1*k*-6 of one color (e.g., K color). In the normal maintenance, the air from the pressurizing pump 52 is supplied to the ink jet heads 1*k*-1 to 1*y*-6 of the respective colors. Consequently, the existing pressurizing pump 52 and air tank 54 can be used without enlarging capacities.

Next, a third embodiment of the present invention will be described with reference to the drawings. It is to be noted that the same components as those of FIGS. 1 to 5 are denoted with the same reference numerals, detailed description thereof is omitted, and different parts will be described.

Figure 9:
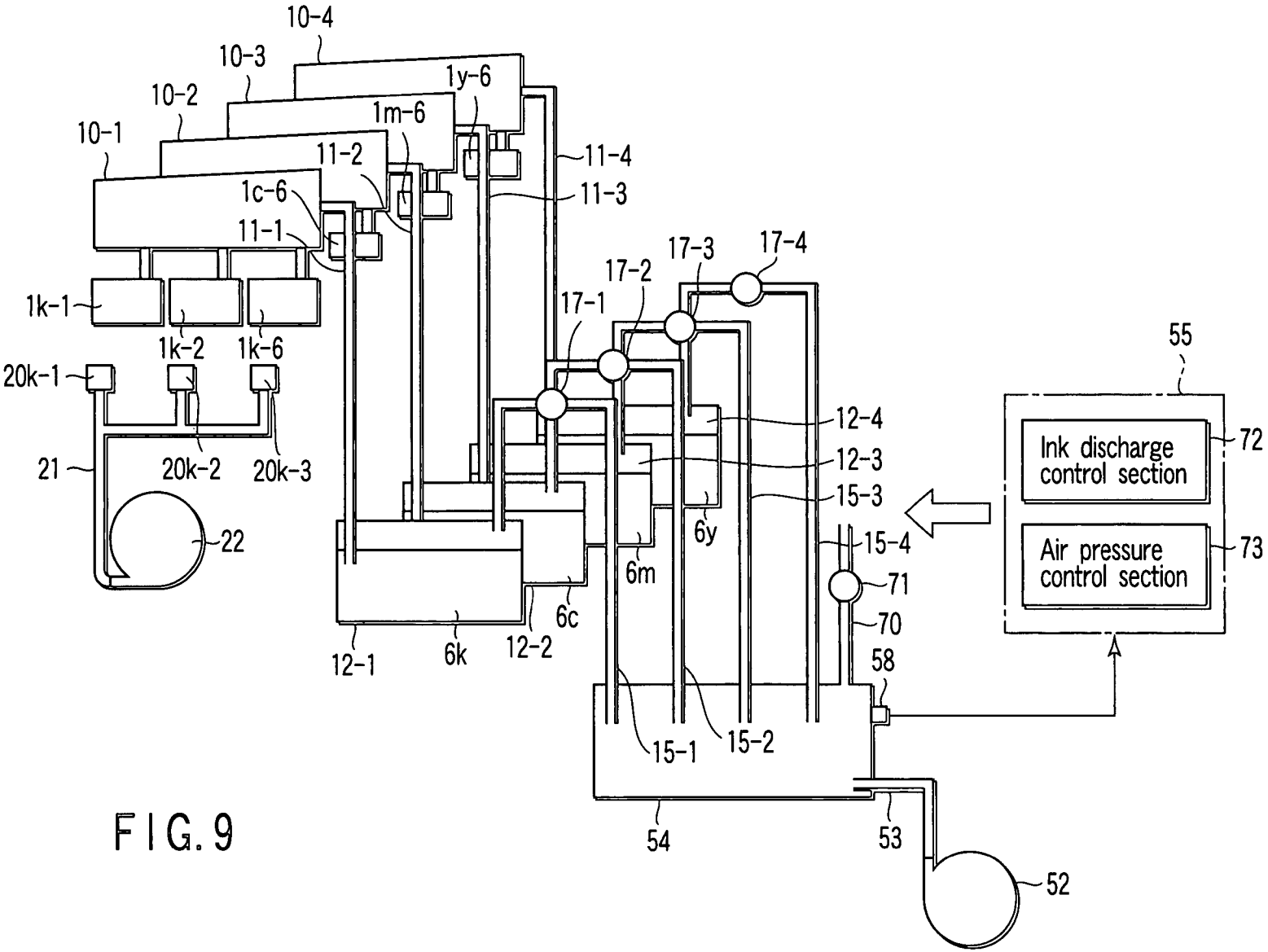
FIG. 9 is a whole constitution diagram showing a third embodiment of the image forming apparatus according to the present invention.

FIG. 9 is a whole constitution diagram of an image forming apparatus. An air tank 54 is provided with one atmosphere open tube 70. The atmosphere open tube 70 is provided with an atmosphere open valve 71. It is to be noted that atmosphere open valves 14-1 to 14-4 disposed in ink tanks 12-1 to 12-4 in the first and second embodiments are removed.

An ink discharge control section 72 inputs a pressure detection signal output from a pressure sensor 58 disposed in the air tank 54, and detects whether or not a pressure in the air tank 54 reaches a predetermined pressure (pressure to such an extent that a pressure Ph applied into the head corresponds to a normal purge pressure Pa).

When the ink discharge control section 72 detects whether or not the pressure in the air tank 54 reaches the predetermined pressure, pressurizing valves 17-1 to 17-4 are opened, and a pressurizing pump 52 is driven in a purge period tp.

Accordingly, the ink discharge control section 72 supplies air to the ink tanks 12-1 to 12-4 from the air tank 54 through the pressurizing valves 17-1 to 17-4, and further supplies the air to ink jet heads 1*k*-1 to 1*y*-6 through distributors 10-1 to 10-4.

Thus, the ink discharge control section 72 raises head inner pressures of the ink jet heads 1*k*-1 to 1*y*-6, and discharges inks 6*k* to 6*y* of colors from the ink jet heads 1*k*-1 to 1*y*-6.

An air pressure control section 73 opens the pressurizing valves 17-1 to 17-4 at the end of the purge period tp. Moreover, the air pressure control section 73 intermittently opens the atmosphere open valve 71 disposed in the air tank 54 a plurality of times, for example, twice simultaneously. Furthermore, the air pressure control section 73 opens the pressurizing valves 17-1 to 17-4 to average the pressures in the ink tanks 12-1 to 12-4.

Figure 10:
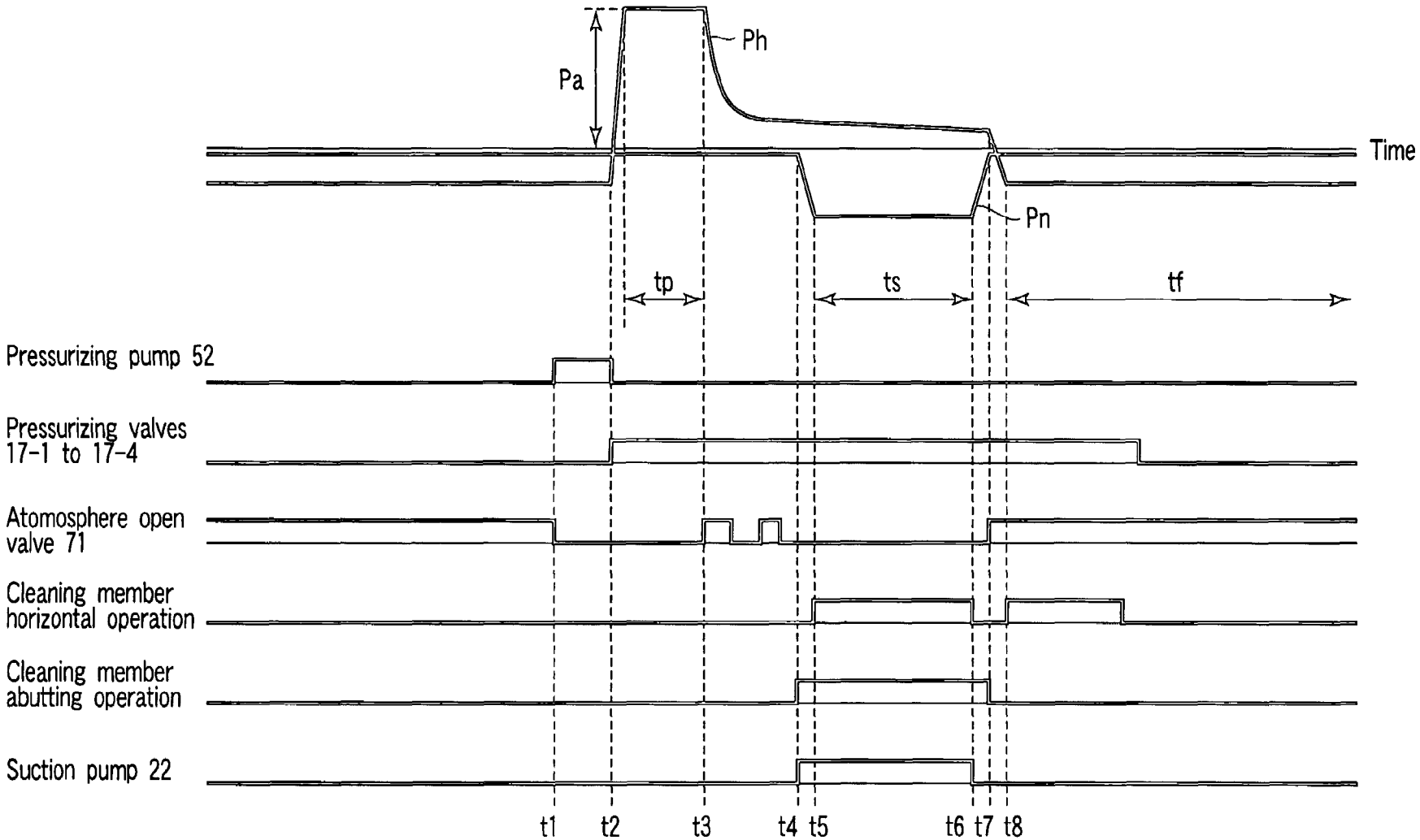
FIG. 10 is a timing chart of normal maintenance in the apparatus.

Next, a normal maintenance operation of the apparatus constituted as described above will be described with reference to a timing chart of normal maintenance shown in FIG. 10. It is to be noted that an only operation different from that of the first embodiment will be described.

After elapse of the purge period tp, the air pressure control section 73 issues an intermittently opening command to the atmosphere open valve 71 a plurality of times, for example, twice simultaneously at a time $t_3$. When the atmosphere open valve 71 is intermittently in an open state, for example, twice simultaneously, the pressure in the air tank 54 drops toward an atmospheric pressure.

At this time, since all the pressurizing valves 17-1 to 17-4 are open, the air tank 54 communicates with all the ink tanks 12-1 to 12-4. Accordingly, the pressure in the air tank 54 drops.

Moreover, the pressures in the ink tanks 12-1 to 12-4 similarly drop through communication tubes 15-1 to 15-4. As a result, the pressures in the nozzles 2 and ink chambers 5 of the ink jet heads 1*k*-1 to 1*y*-6 drop.

When the pressure in the ink chamber 5 of each of the ink jet heads 1*k*-1 to 1*y*-6 drops in a short period by intermittent two opening operations of the atmosphere open valve 71, pressure changes in the ink tanks 12-1 to 12-4 decrease at a time when the atmosphere open valve 71 opens. The pressure in each ink chamber 5 does not turn to a negative pressure.

As a result, even when fluctuations are generated in the pressures in the ink tanks 12-1 to 12-4, the pressures of all the ink tanks 12-1 to 12-4 and the air tank 54 can be averaged by the opening of the atmosphere open valve 71. Accordingly, the pressures in the nozzles 2 and ink chambers 5 of the ink jet heads 1*k*-1 to 1*y*-6 are easily set to micro-positive pressures.

When the atmosphere open valves 14-1 to 14-4 are individually disposed in each color maintenance system as in the first and second embodiments, a difference is made in the micro-positive pressure of each color by an operation timing of each of the atmosphere open valves 14-1 to 14-4. When a plurality of atmosphere open valves 14-1 to 14-4 are disposed, costs increase.

On the other hand, in the third embodiment, four colors are connected, and one atmosphere open valve 71 is disposed. Consequently, an atmosphere open electromagnetic valve having an operation timing in accordance with cost and having a high precision is used, and an optimum micro-positive pressure can be set.

Next, a fourth embodiment of the present invention will be described with reference to the drawings. It is to be noted that the same components as those of FIGS. 1 to 5 are denoted with the same reference numerals, detailed description thereof is omitted.

Figure 11:
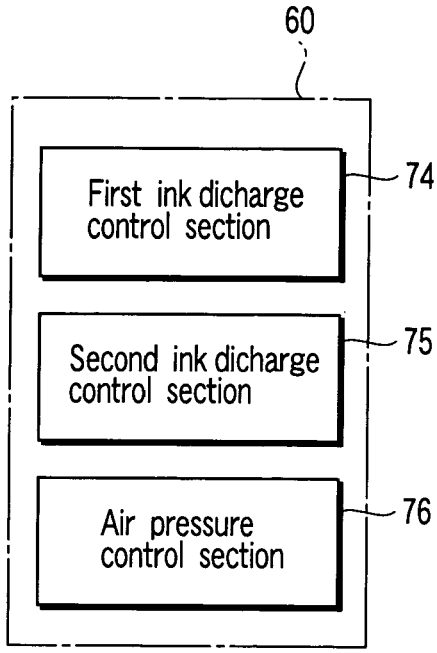
FIG. 11 is a constitution diagram of an image forming control unit showing a fourth embodiment of the image forming apparatus according to the present invention.

FIG. 11 is a constitution diagram of an image forming control unit 60 in an image forming apparatus which performs strong maintenance. The image forming control unit 60 has a first ink discharge control section 74, a second ink discharge control section 75, and an air pressure control section 76 for controlling a strong maintenance operation for the ink jet heads 1*k*-1 to 1*y*-6.

The first ink discharge control section 74 opens an only pressurizing valve 17-1 corresponding to one desired color, for example, K color among pressurizing valves 17-1 to 17-4. Moreover, the first ink discharge control section 74 supplies air to an only ink tank 12-1 corresponding to the K color which is one desired color from a pressurizing pump 52 through an air tank 54.

Accordingly, the first ink discharge control section 74 supplies the air to the ink jet heads 1*k*-1 to 1*k*-6 of the K color from the ink tank 12-1 through a distributor 10-1, raises an head inner pressure Pg in the ink jet heads 1*k*-1 to 1*k*-6, and discharges the ink 6*k* of the K color which is one required color from the ink jet heads 1*k*-1 to 1*k*-6.

The second ink discharge control section 75 opens the pressurizing valves 17-2 to 17-4 corresponding to colors other than the K color which is one required color, for example, C, M, Y colors among the pressurizing valves 17-1 to 17-4, and supplies the air into the ink tanks 12-2 to 12-4 corresponding to the C, M, Y colors which are the other colors from the pressurizing pump 52 through the air tank 54.

Accordingly, the second ink discharge control section 75 supplies the air to the ink jet heads 1*c*-1 to 1*y*-4 corresponding to the C, M, Y colors which are the other colors from the ink tanks 12-2 to 12-4 through the distributors 10-2 to 10-4, raises a head inner pressure Ph of each of the ink jet heads 1*c*-1 to 1*y*-4, and discharges inks 6*c*, 6*m*, 6*y* of the C, M, Y colors which are the other colors from the ink jet heads 1*c*-1 to 1*y*-4.

The air pressure control section 76 opens the pressurizing valves 17-1 to 17-4 at the end of a purge period. Moreover, the air pressure control section 76 intermittently opens an atmosphere open valve 71 disposed in the air tank 54 a plurality of times, for example, twice simultaneously, and further opens the pressurizing valves 17-1 to 17-4. The air pressure control section 76 averages the pressures in the ink tanks 12-1 to 12-4.

Figure 12:
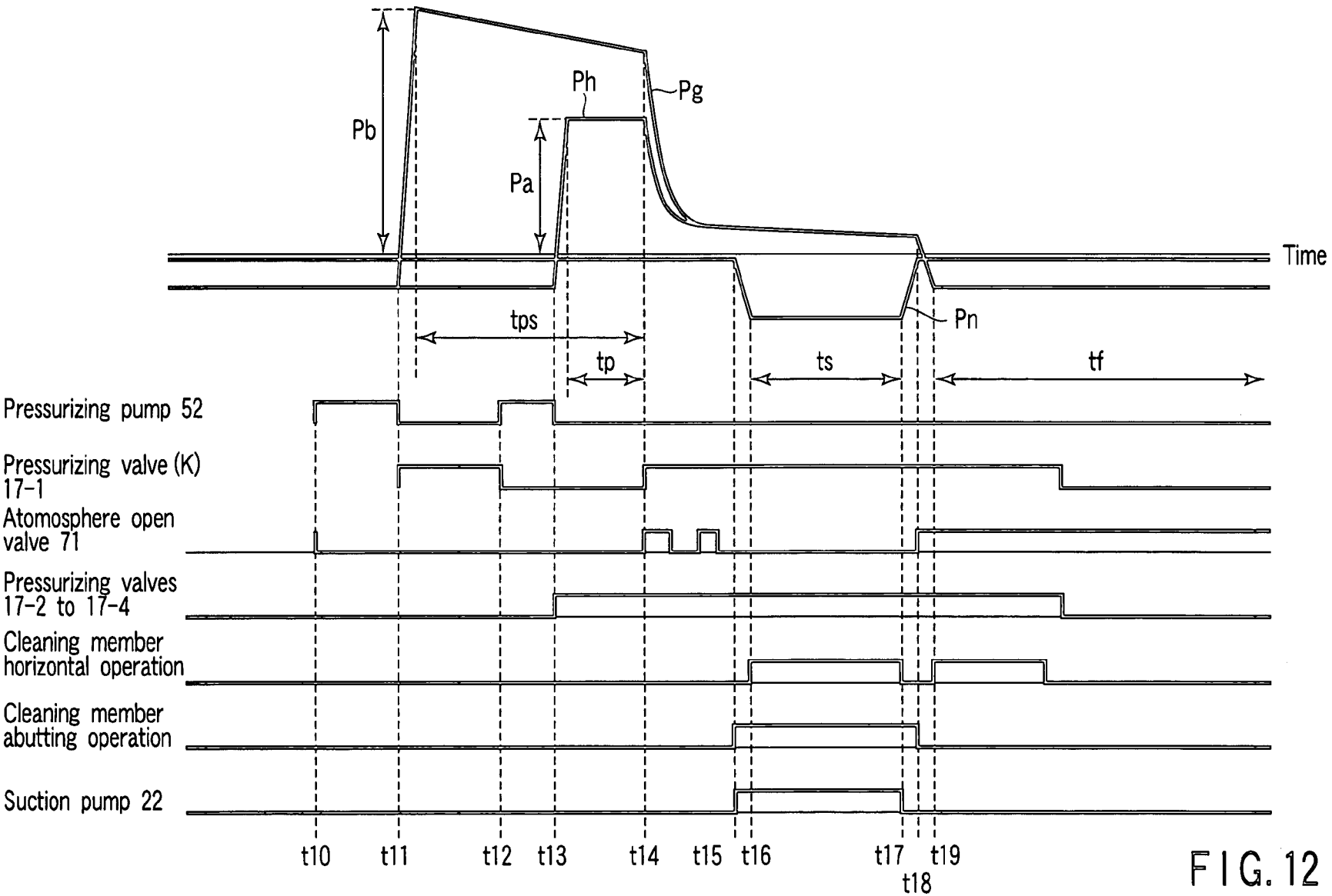
FIG. 12 is a timing chart of strong maintenance in the apparatus.

Next, a strong maintenance operation of the apparatus constituted as described above will be described with reference to a timing chart of the strong maintenance shown in FIG. 12.

When a strong purge period tps and a normal purge period tp elapse, the air pressure control section 76 issues a command to intermittently open the atmosphere open valve 71 a plurality of times, for example, twice simultaneously in a period from a time $t_{14}$ till $t_{15}$. Moreover, the air pressure control section 76 issues a command to maintain open states with respect to all the pressurizing valves 17-1 to 17-4.

Accordingly, the atmosphere open valve 71 intermittently opens a plurality of times, for example, twice simultaneously, and open states of all the pressurizing valves 17-1 to 17-4 are maintained. Accordingly, in the same manner as in the third embodiment, pressure changes in the ink tanks 12-1 to 12-4 at a time when the atmosphere open valve 71 opens decrease. The pressure in each ink chamber 5 does not turn to a negative pressure.

On the other hand, the pressure in the ink tank 12-1 is higher than the pressures in the other ink tanks 12-2 to 12-4 by the strong maintenance. The air pressure control section 76 opens the atmosphere open valve 71 as described above, and also opens all the pressurizing valves 17-1 to 17-4.

Accordingly, all the ink tanks 12-1 to 12-4 communicate with the air tank 54. By this communication, the inner pressures of all the ink tanks 12-1 to 12-4 and the inner pressure of the air tank 54 are averaged.

As a result, even when the pressure in the ink tank 12-1 is different from the pressures in the other ink tanks 12-2 to 12-4 by the strong maintenance, the fluctuations of the pressures in the ink tanks 12-1 to 12-4 are averaged by the communication of all the ink tanks 12-1 to 12-4 with the air tank 54. When the inner pressures of the ink tanks 12-1 to 12-4 and the inner pressure of the air tank 54 are averaged, the pressures in the nozzles 2 and ink chambers 5 of the ink jet heads 1*k*-1 to 1*y*-6 are easily set to micro-positive pressures.

Needless to say, an effect similar to that of the second embodiment is produced even by the fourth embodiment in this manner.

It is to be noted that the present invention is not limited to the above-described embodiments, and may be modified as follows.

For example, the air tank 54 is connected to the ink tanks 12-1 to 12-4 via the communication tubes 15-1 to 15-4 and the pressurizing valves 17-1 to 17-4. On the other hand, to perform the normal maintenance, the communication tubes 15-1 to 15-4 extending from the pressurizing valves 17-1 to 17-4 toward the air tank 54 may be replaced with one communication tube.

Accordingly, the pressurizing valves 17-1 to 17-4 are connected to the air tank 54 via one communication tube.

In the first and third embodiments, after the end of the purge period tp, all the atmosphere open valves 14-1 to 14-4 are intermittently opened a plurality of times, for example, twice simultaneously. On the other hand, even when any atmosphere open valve 14-1, 14-2, 14-3, or 14-4 is opened among the atmosphere open valves 14-1 to 14-4, the air tank 54 is connected to the ink tanks 12-1 to 12-4, and the inner pressures can be averaged.

Figure 14:
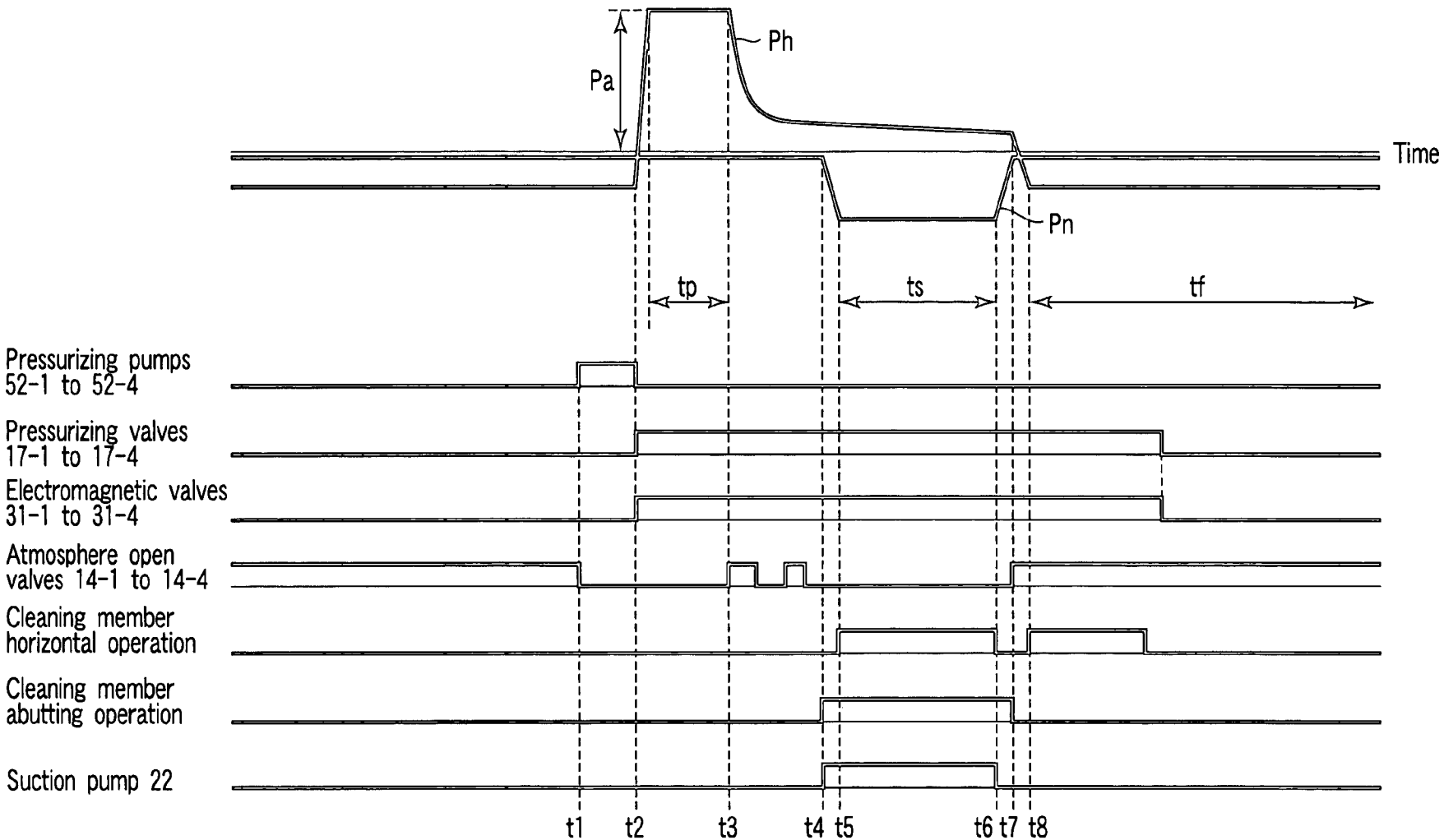
FIG. 14 is a timing chart of the normal maintenance in the apparatus.
Figure 15:
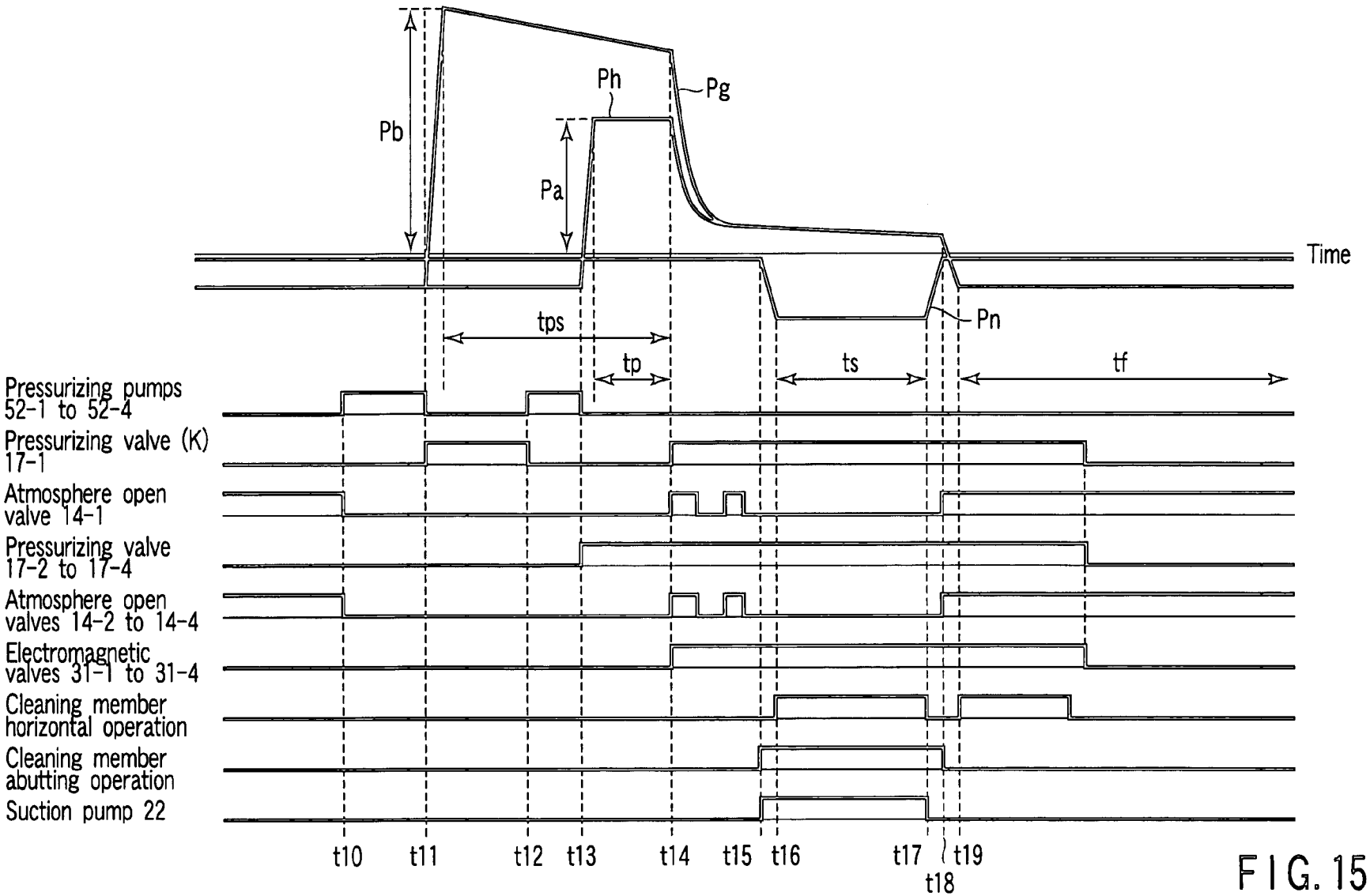
FIG. 15 is a timing chart of the strong maintenance in the apparatus.

Next, a fifth embodiment of the present invention will be described with reference to FIGS. 13 to 15.

Figure 13:
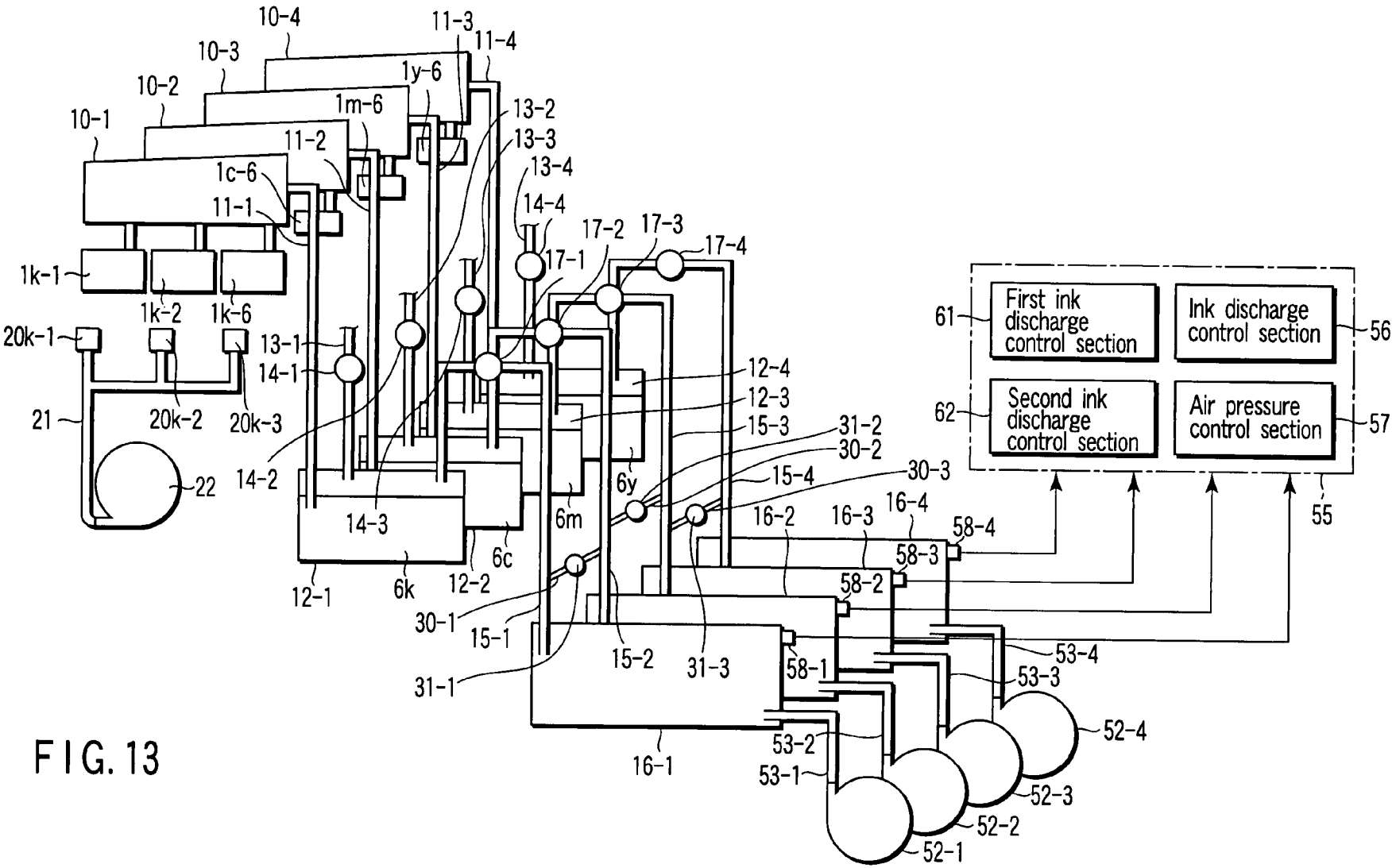
FIG. 13 is a constitution diagram of the image forming control unit showing a fifth embodiment of the image forming apparatus according to the present invention.

FIG. 13 is a constitution diagram of an image forming control unit in an image forming apparatus. In the apparatus, communication tubes 15-1 to 15-4 of colors are connected between ink tanks 12-1 to 12-4 of the respective colors and air tanks 16-1 to 16-4 of the colors. A connection tube 30-1 is connected between the communication tubes 15-1, 15-2. The connection tube 30-1 connects the communication tube 15-1 to 15-2. The connection tube 30-1 is provided with an electromagnetic valve 31-1.

A connection tube 30-2 is connected between the communication tubes 15-2, 15-3. The connection tube 30-2 connects the communication tube 15-2 to 15-3. The connection tube 30-2 is provided with an electromagnetic valve 31-2.

A connection tube 30-3 is connected between the communication tubes 15-3, 15-4. The connection tube 30-3 connects the communication tube 15-3 to 15-4. The connection tube 30-3 is provided with an electromagnetic valve 31-3.

Next, normal maintenance in the apparatus constituted as described above will be described with reference to a timing chart of FIG. 14.

An ink discharge control section 56 issues a driving command with respect to pressurizing pumps 52-1 to 52-4, and also issues a close command with respect to the atmosphere open valves 14-1 to 14-4 at a time $t_1$. By the driving of the pressurizing pumps 52-1 to 52-4, air is supplied into the air tanks 16-1 to 16-4 through pressurizing tubes 53-1 to 53-4. At this time, since all the pressurizing valves 17-1 to 17-4 close, the pressures in the air tanks 16-1 to 16-4 rise.

Pressure sensors 58-1 to 58-4 detect the pressures in the air tanks 16-1 to 16-4, and send pressure detection signals to an image forming control unit 55.

When the pressure in each air tank 16 reaches a pressure (e.g., pressure such that a head inner pressure Pa is, e.g., 10 KPa) required for normal purge at a time $t_2$, the image forming control unit 55 issues a stop command to the pressurizing pumps 52-1 to 52-4 at the time $t_2$. Moreover, the image forming control unit 55 issues an open command with respect to all pressurizing valves 17-1 to 17-4 and electromagnetic valves 31-1 to 31-3.

When the pressurizing valves 17-1 to 17-4 are opened, the pressures in the respective air tanks 16 are applied to the ink tanks 12-1 to 12-4 through the pressurizing valves 17-1 to 17-4. At this time, since the electromagnetic valves 31-1 to 31-3 are also opened, the communication tubes communicate via the connection tubes 30-1, 30-2, 30-3.

As a result, the pressures applied to the ink tanks 12-1 to 12-4 are averaged. The substantially equal pressure is applied to the ink tanks 12-1 to 12-4.

At this time, since the atmosphere open valves 14-1 to 14-4 close, the pressures in the ink tanks 12-1 to 12-4 rise. By these pressure rises, inks 6*k*, 6*c*, 6*m*, 6*y* of colors stored in the ink tanks 12-1 to 12-4 are supplied to distributors 10-1 to 10-4 via tubes 11-1 to 11-4. Furthermore, the inks 6*k*, 6*c*, 6*m*, 6*y* are supplied to the ink jet heads 1*k*-1 to 1*y*-6.

Accordingly, for example, a purge pressure Pa of 3K to 20 KPa is applied into the ink jet heads 1*k*-1 to 1*y*-6, and the inks 6*k*, 6*c*, 6*m*, 6*y* are discharged from the nozzles 2.

The respective inks 6*k*, 6*c*, 6*m*, 6*y* are discharged in a normal purge period tp. The image forming control unit 55 measures the purge period tp by an inner timer, and sets the period, for example, to about 0.3 to 2.0 seconds, preferably about 0.5 to 5 seconds.

When the purge period tp elapses, an air pressure control section 57 issues an intermittent open command with respect to all the atmosphere open valves 14-1 to 14-4 in a period from the time $t_3$ till $t_4$. Accordingly, all the atmosphere open valves 14-1 to 14-4 are intermittently opened. Accordingly, the pressures in the ink tanks 12-1 to 12-4 drop.

As a result, the pressures in the nozzles 2 and ink chambers 5 of the ink jet heads 1*k*-1 to 1*y*-6 drop. The pressures are set to micro-positive pressures (e.g., about 0.1K to 3 KPa) to such an extent that the inks 6*k*, 6*c*, 6*m*, 6*y* do not drip from the nozzles 2 of the ink jet heads 1*k*-1 to 1*y*-6 even after sucking.

It is to be noted that the image forming control unit 55 continuously opens the electromagnetic valves 31-1 to 31-3 while the atmosphere open valves 14-1 to 14-4 are opened ($t_3$ to $t_4$). Accordingly, values of the micro-positive pressures applied into the nozzles 2 and ink chambers 5 of the ink jet heads 1*k*-1 to 1*y*-6 are averaged.

Accordingly, the fluctuations of the pressures in the ink tanks 12-1 to 12-4 caused by fluctuations of performances of the atmosphere open valves 14-1 to 14-4 can averaged for each product. A substantially equal pressure (predetermined micro-positive pressure) can be applied to the ink jet heads 1*k*-1 to 1*y*-6.

It is to be noted that the electromagnetic valves 31-1 to 31-3 continues to open even in a leaving period tf. Accordingly, the electromagnetic valves 31-1 to 31-3 are controlled in such a manner as to close at the same timings as those of the pressurizing valves 17-1 to 17-4.

As described above, the connection tubes 30-1 to 30-3 are disposed between the communication tubes 15-1 to 15-4 which connect the ink tanks 12-1 to 12-4 of the respective colors to the air tanks 16-1 to 16-4 of the colors, and the respective connection tubes 30-1 to 30-3 are provided with the electromagnetic valves 31-1 to 31-3.

In the constitution, all the pressurizing valves 17-1 to 17-4 are opened. Moreover, all the electromagnetic valves 31-1 to 31-3 are opened. All the ink tanks 12-1 to 12-4 communicate with the air tanks 16-1 to 16-4.

Accordingly, the inner pressures of the ink tanks 12-1 to 12-4 can be averaged. A substantially equal predetermined micro-positive pressure can be applied to the ink jet heads 1*k*-1 to 1*y*-6.

Next, a strong maintenance operation will be described with reference to a timing chart of FIG. 15.

At the start of the strong maintenance, as shown in FIG. 5, a maintenance unit 42 is guided by guides 46 to thereby move downwards in a Z-axis direction in response to downward movement of a belt platen 37 in the Z-direction. The maintenance unit 42 moves on a sheet supply side of an image forming medium 34 by operation of a Y-direction driving mechanism 45. Accordingly, cleaning members 20*k*-1 to 20*y*-6 are arranged facing and under the ink jet heads 1*k*-1 to 1*y*-6.

A first ink discharge control section 61 issues driving commands to the pressurizing pumps 52-1 to 52-4, and issues close commands to the atmosphere open valves 14-1 to 14-4 at a time $t_{10}$. The pressurizing pumps 52-1 to 52-4 are driven to thereby supply air into air tanks 16-1 to 16-4 through the pressurizing tubes 53-1 to 53-4. Accordingly, the pressures in the air tanks 16-1 to 16-4 rise. At this time, the electromagnetic valves 31-1 to 31-3 remain closed.

When the pressures in the air tanks 16-1 to 16-4 reach purge pressures (pressures to such an extent that a pressure applied into the head corresponds to Pb) required for strong purge at a time $t_{11}$, the first ink discharge control section 61 issues stop commands to the pressurizing pumps 52-1 to 52-4 at the time $t_{11}$. Moreover, the first ink discharge control section 61 issues an open command only to the pressurizing valve 17-1 corresponding to one required color in which nozzle missing has occurred, for example, K color. It is to be noted that when the color having the nozzle missing is C color, the only pressurizing valve 17-2 corresponding to the C color is opened.

When the pressurizing valve 17-1 is opened in a period from the time $t_{11}$ till time $t_{12}$, a pressure required for the strong purge in the air tank 16-1 is applied only to the ink tank 12-1 through the pressurizing valve 17-1.

At this time, since the atmosphere open valves 14-1 to 14-4 close, the pressure in the ink tank 12-1 rises. The ink 6*k* of K color stored in the ink tank 12-1 is supplied to the distributor 10-1 through a tube 11-1 by the rise of the pressure. Furthermore, the ink 6*k* of the K color is supplied to the ink jet heads 1*k*-1 to 1*k*-6.

Accordingly, the ink 6*k* is strongly discharged from the nozzles 2 of the ink jet heads 1*k*-1 to 1*k*-6 by a purge pressure Pb (e.g., 20K to 50 KPa). When the ink 6*k* is discharged, bubbles, foreign matters and the like in the nozzles 2 and ink chambers 5 are discharged. The nozzle missing can be recovered. The ink 6*k* discharged from each nozzle 2 is discharged to a waste liquid bottle 51.

Next, a second ink discharge control section 62 closes the pressurizing valve 17-1, and issues driving commands to the pressurizing pumps 52-1 to 52-4 at a time $t_{12}$. When the pressurizing pump 52 is driven, the air is supplied into the air tanks 16-2 to 16-4 through the pressurizing tube 53. Accordingly, the pressure in the tank rises.

When the pressures in the air tanks 16-2 to 16-4 reach a purge pressure required for normal pure at a time $t_{13}$, the second ink discharge control section 62 issues a stop command to the pressurizing pump 52 at the time $t_{13}$, and issues open commands to the pressurizing valves 17-2 to 17-4 corresponding to colors other than the K color, that is, C, M, Y colors.

When the pressurizing valves 17-2 to 17-4 are opened, the pressures in the air tanks 16-2 to 16-4 are applied to the ink tanks 12-2 to 12-4 through the pressurizing valves 17-2 to 17-4.

When the pressures in the ink tanks 12-2 to 12-4 rise, inks 6*c*, 6*m*, 6*y* of the colors stored in the ink tanks 12-2 to 12-4 are supplied to the distributors 10-2 to 10-4 through tubes 11-2 to 11-4. Furthermore, the inks 6*c*, 6*m*, 6*y* are supplied to the ink jet heads 1*c*-1 to 1*y*-6. Accordingly, a purge pressure Pa is applied to each of the ink jet heads 1*c*-1 to 1*y*-6.

Accordingly, the respective inks 6*c*, 6*m*, 6*y* are discharged from the nozzles 2 of the ink jet heads 1*c*-1 to 1*y*-6 corresponding to the C, M, Y colors. When the inks 6*c*, 6*m*, 6*y* are discharged, bubbles, foreign matters and the like in the nozzles 2 and ink chambers 5 are discharged. The inks 6*c*, 6*m*, 6*y* discharged from the nozzles 2 are discharged to the waste liquid bottle 51.

At a time $t_{14}$, the air pressure control section 57 issues a command to maintain an open state with respect to the pressurizing valve 17-1. The air pressure control section 57 issues a command to intermittently open all the atmosphere open valves 14-1 to 14-4 a plurality of times, for example, twice in a period from the time $t_{14}$ till $t_{15}$. Accordingly, all the atmosphere open valves 14-1 to 14-4 intermittently open a plurality of times, for example, twice simultaneously. All the pressurizing valves 17-1 to 17-4 open.

At the time $t_{14}$, the air pressure control section 57 opens the electromagnetic valves 31-1 to 31-3. Accordingly, all the ink tanks 12-1 to 12-4 communicate with the air tanks 16-1 to 16-4.

Accordingly, even when a difference is made between the pressure in the ink tank 12-1 and the pressures in the other ink tanks 12-2 to 12-4, the respective inner pressures of all the ink tanks 12-1 to 12-4 and the inner pressures of the air tanks 16-1 to 16-4 are averaged. Substantially predetermined micro-positive pressures are applied into the nozzles 2 and ink chambers 5 of the ink jet heads 1*k*-1 to 1*y*-6.

Moreover, fluctuations of performances of the atmosphere open valves 14-2 to 14-4 are large for each product. For example, even when the open commands are received at the same timing, the atmosphere open valves 14-2 to 14-4 do not simultaneously open because of an electrical or mechanical delay or the like in some case. Even the pressure differences produced by the fluctuations of the open timings of the atmosphere open valves 14-2 to 14-4 are averaged by the communication of all the ink tanks 12-1 to 12-4 with the air tanks 16-1 to 16-4.

Thereafter, the inks 6*k*, 6*c*, 6*m*, 6*y* are slightly discharged from the nozzles 2 of the ink jet heads 1*k*-1 to 1*y*-6. Additionally, in the same manner as in the first embodiment, the pressures in the nozzle 2 and ink chamber 5 of the ink jet heads 1*k*-1 to 1*y*-6 are set to micro-positive pressures to such an extent that the ink does not drip from the nozzle plate, for example, about 0.1 k to 3 kPa.

Next, the image forming control unit 55 positions the cleaning members 20*k*-1 to 20*y*-6 with respect to the ink jet heads 1*k*-1 to 1*y*-6 at the time $t_{15}$, and allows the cleaning members 20*k*-1 to 20*y*-6 to abut on the ink jet heads 1*k*-1 to 1*y*-6.

Moreover, the image forming control unit 55 issues a suction command to the suction pump 22 at the time $t_{15}$. Accordingly, the cleaning members 20*k*-1 to 20*y*-6 start suction of suction nozzles 48, 49 shown in FIG. 3.

When negative pressures applied to the cleaning members 20*k*-1 to 20*y*-6 by the air suction by the suction pump 22 are stabilized at predetermined values, the image forming control unit 55 issues a driving command to an X-direction driving mechanism 44 at a time $t_{16}$. Accordingly, the maintenance unit 42 moves in an X-direction (nozzle arrangement direction) in a sucking period ts.

Accordingly, the cleaning members 20*k*-1 to 20*y*-6 slide over the whole nozzle plates 3 of the ink jet heads 1*k*-1 to 1*y*-6. The cleaning members 20*k*-1 to 20*y*-6 scrape and suck the inks 6*k*, 6*c*, 6*m*, 6*y* discharged onto the nozzle plates 3 of the ink jet heads 1*k*-1 to 1*y*-6. Accordingly, the cleaning members 20*k*-1 to 20*y*-6 remove deposits sticking to the nozzle plates 3.

At this time, since the respective cleaning members 20*k*-1 to 20*y*-6 suck the inks 6*k*, 6*c*, 6*m*, 6*y* on the nozzle plates 3 of the ink jet heads 1*k*-1 to 1*y*-6. Accordingly, the ink liquid level does not move between each nozzle 2 and the ink chamber 5. There is not any possibility that the air is involved in the ink chamber 5.

The image forming control unit 55 issues a stop command to an X-direction driving mechanism 44, and also issues a stop command to the suction pump 22 at a time $t_{17}$ when the sucking period ts ends.

Next, the image forming control unit 55 moves down the cleaning members 20*k*-1 to 20*y*-6 to thereby detach the members from the ink jet heads 1*k*-1 to 1*y*-6 at a time $t_{18}$ when a leaving period tf starts.

The image forming control unit 55 issues open commands to the atmosphere open valves 14-1 to 14-4 at the time $t_{18}$. Accordingly, the atmosphere open valves 14-1 to 14-4 open.

When the atmosphere open valves are left in this state, back pressures are applied into the ink chambers 5 of the ink jet heads 1*k*-1 to 1*y*-6. Accordingly, meniscuses 7 are formed in the nozzles 2 of the ink jet heads 1*k*-1 to 1*y*-6. Thus, the ink jet heads 1*k*-1 to 1*y*-6 return-to image formable states.

Thereafter, the maintenance unit 42 moves backwards in the X-direction, and returns to its original position at a time $t_{19}$. When the pressure in the air tank becomes equal to an atmospheric pressure, the pressurizing valves 17-1 to 17-4 are closed, and the state returns to an initial state.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a plurality of ink tanks which store ink;

a plurality of ink jet heads which jet the ink supplied from the respective ink tanks to thereby form an image on an image forming medium;

a pressurizing pump which supplies air;

an air tank which communicates with the pressurizing pump;

a plurality of pressurizing valves which connect the air tank to the respective ink tanks, respectively;

atmosphere open valves which are disposed in the respective ink tanks and at least one of the air tanks in such a manner that the inside of the air tank is openable to the atmosphere;

an ink discharge control unit which opens the respective pressurizing valves and which drives the pressurizing pump and which supplies air to the respective ink jet heads from the air tank through the respective ink tanks to raise head inner pressures of the respective ink jet heads and which discharges the ink from the respective ink jet heads; and a pressure averaging control mechanism which discharges the ink from the respective ink jet heads and which thereafter opens the respective pressurizing valves and which opens the atmosphere open valve to thereby average the pressures in the respective ink tanks.

2. The image forming apparatus according to claim 1, wherein the pressure averaging control mechanism intermittently opens the atmosphere open valve a plurality of times.

3. The image forming apparatus according to claim 1, wherein the pressure averaging control mechanism intermittently opens the atmosphere open valve twice.

4. The image forming apparatus according to claim 1, wherein the atmosphere open valve is disposed for each of the ink tanks, and the pressure averaging control mechanism intermittently opens the respective atmosphere open valves a plurality of times substantially at the same time.

5. The image forming apparatus according to claim 1, further comprising:

a plurality of cleaning members disposed facing the respective ink jet heads;

a suction pump which sucks the air from the respective cleaning members;

a sucking mechanism which discharges the ink from the respective ink jet heads and which thereafter slides the respective cleaning members with respect to the respective ink jet heads to thereby perform the sucking; and a meniscus forming mechanism which sets the respective head inner pressures of the respective ink jet heads to negative pressures after the sucking to thereby form meniscuses.

6. The image forming apparatus according to claim 5, wherein the sucking mechanism performs the sucking while the respective head inner pressures of the ink jet heads are set to an equal micro-positive pressure substantially at the same time.

7. The image forming apparatus according to claim 6, wherein the micro-positive pressure is set to 0.1 to 3 KPa.

8. The image forming apparatus according to claim 1, wherein the ink has colors of black, cyan, magenta, and yellow, and the respective ink jet heads discharge the ink of the respective colors.

9. An image forming apparatus comprising:

a plurality of ink tanks which store ink;

a plurality of ink jet heads which jet the ink supplied from the respective ink tanks to thereby form an image on an image forming medium;

a pressurizing pump which supplies air;

an air tank which communicates with the pressurizing pump;

a plurality of pressurizing valves which connect the air tank to the respective ink tanks, respectively;

atmosphere open valves which are disposed in the respective ink tanks and at least one of the air tanks in such a manner that the inside of the air tank is openable to the atmosphere;

a first ink discharge control unit which opens the only pressurizing valve corresponding to the desired ink jet head among the respective pressurizing valves and which supplies the air into the only ink tank corresponding to the desired ink jet head from the pressurizing pump through the air tank and which raises a head inner pressure of the ink jet head corresponding to the ink tank and which discharges the required ink from the ink jet head; and a pressure averaging control mechanism which discharges the ink from the desired ink jet head and which thereafter opens the respective pressurizing valves and which opens the atmosphere open valve to thereby average the pressures in the respective ink tanks via the air tank.

10. The image forming apparatus according to claim 9, further comprising:

a second ink discharge control unit which opens the pressurizing valves other than the desired pressurizing valve among the respective pressurizing valves and which supplies the air into the ink tanks corresponding to the other pressurizing valves from the pressurizing pump through the air tank and which raises a head inner pressure of the ink jet head corresponding to the ink tank and which discharges the corresponding ink from the ink jet head.

11. The image forming apparatus according to claim 10, wherein the first ink discharge control unit sets the head inner pressure applied to the ink jet head to be higher than that applied to the ink jet head by the second ink discharge control unit, and performs strong maintenance with respect to the ink jet head.

12. The image forming apparatus according to claim 10, wherein the second ink discharge control unit sets the head inner pressure applied to the ink jet head to be lower than that applied to the ink jet head by the first ink discharge control unit, and performs normal maintenance with respect to the ink jet head.

13. The image forming apparatus according to claim 10, wherein the first ink discharge control unit sets the head inner pressure applied to the ink jet head to be higher than that applied to the ink jet head by the second ink discharge control unit, and performs strong maintenance with respect to the ink jet head, and the second ink discharge control unit sets the head inner pressure applied to the ink jet head to be lower than that applied to the ink jet head by the first ink discharge control unit, and performs normal maintenance with respect to the ink jet head, and the pressure averaging control mechanism intermittently opens the air tank to the atmosphere at the same time during the strong maintenance and the normal maintenance a plurality of times.

14. The image forming apparatus according to claim 9, wherein the pressure averaging control mechanism intermittently opens the atmosphere open valve a plurality of times.

15. The image forming apparatus according to claim 9, wherein the pressure averaging control mechanism intermittently opens the atmosphere open valve twice.

16. The image forming apparatus according to claim 9, wherein the atmosphere open valve is disposed for each of the ink tanks, and the pressure averaging control mechanism intermittently opens the respective atmosphere open valves a plurality of times substantially at the same time.

17. The image forming apparatus according to claim 9, further comprising:

a plurality of cleaning members disposed facing the respective ink jet heads;

a suction pump which sucks the air from the respective cleaning members;

a sucking mechanism which discharges the ink from the respective ink jet heads and which thereafter slides the respective cleaning members with respect to the respective ink jet heads to thereby perform the sucking; and a meniscus forming mechanism which sets the respective head inner pressures of the respective ink jet heads to negative pressures after the sucking to thereby form meniscuses.

18. The image forming apparatus according to claim 17, wherein the sucking mechanism performs the sucking while the respective head inner pressures of the ink jet heads are set to an equal micro-positive pressure substantially at the same time.

19. The image forming apparatus according to claim 18, wherein the micro-positive pressure is set to 0.1 to 3 KPa.

20. The image forming apparatus according to claim 9, wherein the ink has colors of black, cyan, magenta, and yellow, and the respective ink jet heads discharge the ink of the respective colors.

21. An image forming apparatus comprising:

a plurality of ink tanks which store ink of colors of black, cyan, magenta, and yellow by the respective colors;

a plurality of ink jet heads which jet the ink supplied from the respective ink tanks to thereby form an image on an image forming medium;

a pressurizing pump which supplies air;

an air tank which communicates with the pressurizing pump;

a plurality of communication tubes disposed between the air tank and the respective ink tanks;

a plurality of pressurizing valves which are disposed in the respective communication tubes and which connect the air tank to the respective ink tanks, respectively;

at least one atmosphere open valve which is disposed in such a manner as to communicate with the respective ink tanks and at least one of the air tanks;

a first ink discharge control unit which opens the only pressurizing valve corresponding to the desired ink jet head among the respective pressurizing valves and which supplies the air into the only ink tank corresponding to the desired ink jet head from the pressurizing pump through the air tank and which raises a head inner pressure of the ink jet head through the ink tank and which discharges the ink from the desired ink jet head;

a second ink discharge control unit which opens the respective pressurizing valves corresponding to the ink jet heads other than the desired ink jet head among the plurality of pressurizing valves and which supplies the air into the respective ink tanks corresponding to the other ink jet heads from the pressurizing pump through the air tank and which raises the respective head inner pressures of the ink jet heads through the respective ink tanks and which discharges the ink from the respective ink jet heads, the first ink discharge control unit setting the head inner pressure applied to the ink jet head to be higher than that applied to the ink jet head by the second ink discharge control unit;

an air pressure control unit which discharges the ink from the respective ink jet heads and which thereafter opens the respective pressurizing valves and which intermittently opens the atmosphere open valve a plurality of times substantially at the same time to thereby average the pressures in the respective ink tanks;

a plurality of cleaning members disposed facing the respective ink jet heads;

a suction pump which sucks the air from the respective cleaning members;

a sucking mechanism which discharges the ink from the respective ink jet heads and which thereafter slides the respective cleaning members with respect to the respective ink jet heads while keeping the respective head inner pressures of the ink jet heads at an equal micro-positive pressure substantially at the same time to thereby perform the sucking; and a meniscus forming mechanism which sets the respective head inner pressures of the respective ink jet heads to negative pressures after the sucking to thereby form meniscuses.

* * * * *